US006888508B2

(12) United States Patent
Lindenmeier

(10) Patent No.: US 6,888,508 B2
(45) Date of Patent: May 3, 2005

(54) ACTIVE BROAD-BAND RECEPTION ANTENNA WITH RECEPTION LEVEL REGULATION

(75) Inventor: Heinz Lindenmeier, Planegg (DE)

(73) Assignee: FUBA Automotive GmbH & Co. KG, Bad Salzdetfurth (DE)

( * ) Notice: Subject to any disclaimer, the term of this patent is extended or adjusted under 35 U.S.C. 154(b) by 35 days.

(21) Appl. No.: 10/674,718

(22) Filed: Sep. 30, 2003

(65) Prior Publication Data

US 2004/0113854 A1 Jun. 17, 2004

(30) Foreign Application Priority Data

Oct. 1, 2002 (DE) ..... 102 45 813

(51) Int. Cl.[7] ..... H01Q 1/32
(52) U.S. Cl. ..... 343/713; 343/704
(58) Field of Search ..... 343/713, 704, 343/850, 853, 860; H01Q 1/32

(56) References Cited

U.S. PATENT DOCUMENTS

| | | | | |
|---|---|---|---|---|
| 3,699,452 A | | 10/1972 | Lindemeier et al. | |
| 3,942,119 A | | 3/1976 | Meinke et al. | |
| 4,914,446 A | | 4/1990 | Lindenmeier et al. | |
| 5,029,308 A | | 7/1991 | Lindenmeier et al. | |
| 5,097,270 A | | 3/1992 | Lindenmeier et al. | |
| 5,266,960 A | | 11/1993 | Lindenmeier et al. | |
| 5,408,242 A | * | 4/1995 | Nakase | 343/704 |
| 5,801,663 A | | 9/1998 | Lindenmeier et al. | |
| 5,905,469 A | * | 5/1999 | Lindenmeier et al. | 343/713 |
| 6,072,435 A | * | 6/2000 | Terashima et al. | 343/713 |
| 6,201,505 B1 | * | 3/2001 | Terashima et al. | 343/713 |
| 6,236,372 B1 | | 5/2001 | Lindenmeier et al. | |
| 6,243,043 B1 | * | 6/2001 | Terashima et al. | 343/713 |
| 6,603,435 B2 | * | 8/2003 | Lindenmeier et al. | 343/713 |

FOREIGN PATENT DOCUMENTS

| | | |
|---|---|---|
| DE | 1591300 | 8/1970 |
| DE | 1919749 | 10/1970 |
| DE | 2310616 | 10/1976 |
| DE | 4323014 | 1/1995 |
| EP | 0396033 | 4/1990 |
| EP | 0269723 | 3/1993 |
| EP | 0346591 | 3/1994 |

* cited by examiner

*Primary Examiner*—Hoanganh Le
(74) *Attorney, Agent, or Firm*—Collard & Roe, P.C.

(57) ABSTRACT

An active broad-band reception antenna, in which the internal amplification of the active antenna is lowered if a predetermined signal level is exceeded, and which consists of a passive antenna part having output connectors that are connected with the input connectors of an amplifier circuit. The input circuit of the amplifier circuit contains a three-pole amplification element with its impedance control connector being connected with the first connector of the passive antenna part, at high frequency. The input admittance of a transformation network having the nature of a low loss filter for low amplitude, high-frequency reception signals, has a counter-coupling and linearizing effect in the high-frequency connection between the source connector of the three-pole amplification element and the second connector of the passive antenna part. The transformation network is loaded with a continuing circuit at its output. There is at least one adjustable electronic element, responsive to a control amplifier connected to the output of the active amplifier for adjustably lowering the reception level, and disposed in the transformation network, so that the input admittance of the transformation network, that has the linearizing effect, is reduced, if there is a reduction of the high-frequency reception signal.

46 Claims, 16 Drawing Sheets

$Z_A(f)=R_A(f)+jX_A(f)$
$\underline{E}\cdot\underline{I}_e(f)$
$\underline{i}_r\cdot\underline{Z}_A(f)$
$\underline{u}_r$
$\underline{i}_r$
$\underline{Y}(f)=G(f)+jB(f)$
$\approx \underline{Z}_{opt}$
$\underline{Z}_s(f)$
$\underline{E}\cdot\underline{I}_s$
$\underline{Z}_A \approx \underline{Z}_{opt}$

ACTIVE BROAD-BAND RECEPTION ANTENNA WITH RECEPTION LEVEL REGULATION

BACKGROUND OF THE INVENTION

1. Field of the Invention

The invention relates to an active broad-band reception antenna for vehicles consisting of a passive antenna part having a frequency-dependent effective length $l_e$, and the output connectors are connected, at high frequency, with the input connectors of an amplifier circuit. Electrically long antennas or antennas that are in direct coupling with electrically large bodies have a frequency-dependent no-load voltage, when excited by way of an electrical field intensity that is kept constant above the frequency. This no-load voltage is expressed by means of the effective length $l_e(f)$. Particularly in the high-frequency range above 30 MHz, the antenna noise temperature $T_A$ in a terrestrial environment, which comes from low frequencies, has decreased to such a level that a source impedance in the vicinity of the optimal impedance for the transistor $\underline{Z}_{opt}$ is required for bipolar transistors, for noise adjustment, so that there is not a significant loss in sensitivity due to transistor noise. The basic form of an active antenna of this type is known, for example, from DT-AS 23 10 616, DT-AS 15 91 300, and AS 1919749. In the case of active broad-band antennas that are not tuned in channel-selective manner, but rather to a frequency band, such as the VHF radio frequency range, in broad-band manner, it is necessary to transform the antenna impedance $\underline{Z}_S(f)$ of a short emitter to $\underline{Z}_A(f)$ in the vicinity of $\underline{Z}_{opt}$ (see VHF range in DT-AS 23 10 616), or the emitter itself, so that the antenna impedance $\underline{Z}_S(f)$ itself lies in the vicinity of $\underline{Z}_{opt}$ (see VHF range in AS 1919749 and emitter in). This results in a frequency-dependent no-load voltage at the transistor input, both for electrically large antennas, and for electrically small antennas. This no-load voltage is expressed as a highly frequency-dependent effective length $l_e(f)$ of the passive antenna part. An adaptation circuit at the output of the active circuit is required in connection with the frequency dependence of the voltage splitting factor, between $\underline{Z}_{opt}$ and the input resistance of the transistor, (which differs from the latter) to smooth out the resulting frequency response of the reception signal at the load resistor $Z_L$. This is also necessary in order to protect the reception system connected on the load side from non-linear effects due to level overload.

2. The Prior Art

In the case of broad-band reception antennas, severe reception problems can occur due to the high electrical field intensities in the vicinity of the transmitter, for example due to on-board transmitters, because of intermodulation and limitation effects in the electronic amplifier of the active reception antenna. Here, the amplifier parameters are selected for providing high sensitivity and broad-band adherence to the electrical properties. The technology used is generally very complicated, with the effort and expense increasing greatly with greater demands on the intermodulation resistance. For active reception antennas that use a rectifier circuit with a control circuit in order to determine the signal levels, however, more cost-effective amplifiers can be used, since they are able to lower the internal amplification of the active reception antenna when a predetermined reception level is exceeded, in order to avoid reception problems caused by intermodulation and limitation effects in the amplifier, and in the circuit that passes the signal on.

German Patent DE 43 23 014 describes an active broad-band antenna in which the antenna impedance to be measured is transformed into the optimal source impedance of the electronic amplifier connected on the load side, by means of a low-loss transformation network, in order to achieve an optimal signal-noise ratio. In order to protect the reception system connected on the load side from non-linear effects due to level overload, lowering of the internal amplification of the active antenna is frequently necessary. In DE 43 23 014, this is determined when a predetermined reception level has been exceeded, using a rectifier circuit, and the internal amplification of the active antenna is lowered using a control amplifier. This takes place using a passive, signal-attenuating network, which bridges the active antenna part. Electronic switches are used to lower the internal amplification of the active reception antenna, wherein the signal path is split up, by way of the electronic amplifier, at its input, or output or at its input and output. The load that occurs at the amplifier input because of the bridging, signal-attenuating network, together with the switching measures to be affixed there, causes interference.

The basic form of active antennas, having a transformation network at the amplifier input, such as used, for example, as broad-band antennas for the VHF range is known from DT-AS 23 10 616 and DT-AS 15 91 300. Active antennas according to this state of the art are used, above the high-frequency range, with antenna arrangements in a motor vehicle window, together with a heating field for the window heater, as described, for example, in EP 0 396 033, EP 0 346 591, and in EP 0 269 723. The structures of the heating fields, used as the passive antenna part, were not originally intended for use as an antenna, and cannot be changed very much because of their function as part of the heating system. If an active antenna according to the state of the art is designed as an antenna element, the impedance that is present at the heating field must be transformed into the vicinity of the impedance $Z_{opt}$ for noise adaptation, using a primary adaptation circuit. The frequency response of the active antenna must then be smoothened out, using an output-side adaptation network. This method of procedure requires a relatively complicated design of two filter circuits, which cannot operate separately for each filter, because of the mutual dependence on one another, in order to achieve an advantageous overall behavior of the active antenna. In addition, the amplifier circuit cannot be structured as a simple amplification element, in order to achieve sufficient linearity properties. This significantly restricts the freedom in the design of the two adaptation networks. Furthermore, an increased amount of design and expense is connected with the construction of two filters. Another noteworthy disadvantage of an active antenna of this type is the load on the adaptation circuit with an amplifier connected on the load side that is connected with the heating field. Here, several active antennas are structured from the same heating field, in order to form an antenna diversity system, i.e. a group antenna having particular directional properties or other purposes. This disadvantageous situation exists for all antenna arrangements whose passive antenna parts are in a noteworthy electromagnetic passive coupling with one another. For example, according to the state of the art, switching diodes for the antenna amplifier are placed at the connection points formed on the heating field. In the case of a multi-antenna scanning diversity system formed from a heating field, each of the diodes only turns on that adaptation circuit with amplifier whose signal is switched through to the receiver, and thus releases the other connection points. This results in a significant effort and expense, and additionally requires the diodes to be switched in precise synchronicity with the antenna selection.

SUMMARY OF THE INVENTION

It is therefore an object of the invention to provide an active broad-band antenna having a freely selectable frequency dependence of the reception output with a given passive part, while assuring a high level of noise sensitivity and a high level of linearity, essentially independent of the frequency dependence of the effective length and the impedance of the passive antenna part. Moreover, an effective device is provided for lowering the internal amplification of the active antenna if a predetermined signal level is exceeded, in order to provide protection against any non-linear effects.

The invention provides a reduction in the economic effort and expense, and simplicity in achieving an optimal reception signal, with regard to the signal-noise ratio, and the problems caused by non-linear effects. The high level of linearity of the circuits three-pole amplification element allows the internal amplification of the active antenna to be lowered at the output of this element, while at the same time, providing an increase in the linearizing counter-coupling. The elimination of a primary adaptation network in connection with the high input impedance of the amplifier circuit allows for a very advantageous freedom in the design of complicated multi-antenna systems, whose passive antenna parts are passively coupled with one another. This results in having the advantage that there is no noticeable reciprocal influence on the reception signals for multi-antenna arrangements with multiple uncoupling of reception signals from a passive antenna arrangement, having several connection points, that are in electromagnetic passive coupling with one another, due to the active antennas. In connection with the diversity arrangement, the aforementioned switching diodes, for releasing connection points at which no signal for switching through to the receiver is in use, in each instance, can therefore be eliminated, in advantageous manner.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
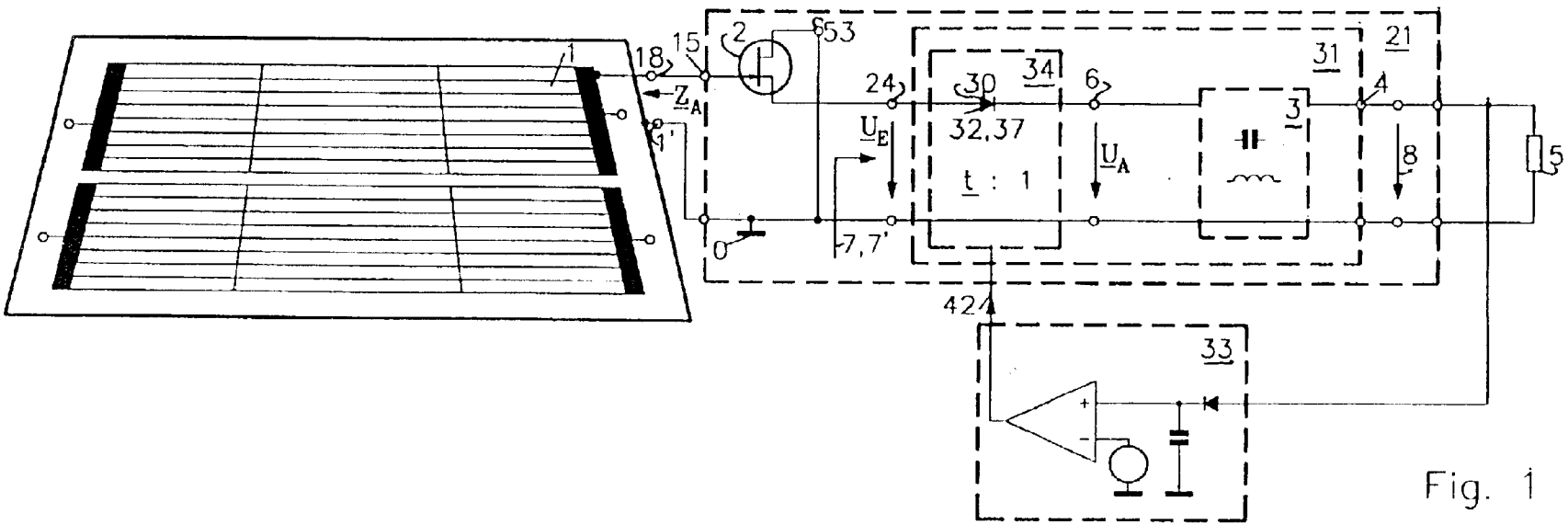
FIG. 1 shows an active broad-band reception antenna according to the invention.

Referring now in detail to the drawings, FIG. 1 shows an antenna according to the basic form of the invention, having an amplifier circuit 21, directly connected with the first connector 18 of the passive antenna part 1, and having a high frequency, high impedance control connector 15 connected to the input of a three-pole amplification element 2. There is an input admittance 7, located in the input line 24, of a transformation network 31, with an adjustable transformation member 34, in the form of a series impedance, implemented as an adjustable electronic element 32. A low-loss filter circuit 3 is connected on the load side 6, and an active resistor 5 that acts on the output side 4. A control amplifier 33 has its input connected to resistor 5, and its output fed back through line 42, and connected to control circuit 34. Using the example of a heating field of a motor vehicle printed onto a window, it is evident that passive antenna part 1 cannot be designed to have particularly desirable properties for use as an antenna in the meter and decimeter wavelength range, and therefore has to have a random frequency dependence both of its effective length $l_e$ and in its impedance, in accordance with its geometrical structure and the metal edging of the window. The present invention provides an active antenna that picks up this randomness of the frequency dependence of the given passive antenna part 1, using an active antenna that is not complicated, easy to design, and simple to implement. Moreover, it is designed advantageously with regard to inherent noise, linearity, and frequency response, and achieves a predetermined frequency response between the incident wave having the electrical field intensity E, and the high-frequency reception signal 8. According to the invention, the reception voltage that is present at a connection point 18 is coupled to amplifier circuit 21, through the input of a three-pole amplification element 2, preferably a field effect transistor 2, that is counter-coupled at its output line with the input admittance 7 of low-loss filter circuit 3, shown connected with an effective active resistor 5. For an antenna of this type, input admittance 7 must be designed, according to the invention, so that the strong frequency dependence, for the reception no-load voltage, expressed by the effective length $l_e$ of the passive antenna part 1, essentially balanced out in the high-frequency reception signal 8. In order to lower the reception signal levels in the range of very large reception field intensities, an adjustable series component 30 is provided in adjustable transformation member 34, and responsive to control amplifier 33, which serves as a through circuit in the range of low reception levels. If the series component 30 is set to a high impedance in the range of excessively large reception levels, it causes a reduction of the high-frequency reception signal 8, on the one hand, as well as an increase of the impedance that acts in a counter-coupled manner in the output line of transistor 2, causing a reduction in admittance 7' that is present there. Therefore field effect transistor 2 is linearized by means of this measure, and the continuation circuit or load 5 is protected against very large reception levels.

Figure 3:
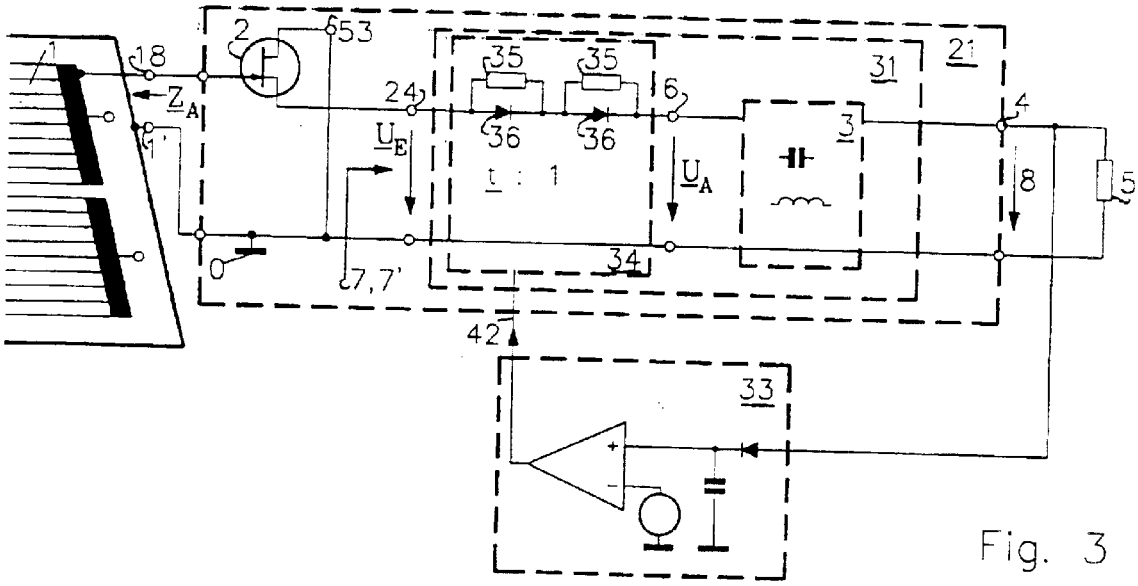
FIG. 3 shows an alternative embodiment of the antenna according to FIG. 1.

FIG. 3 shows an active broad-band reception antenna according to FIG. 1, but with an adjustable transformation member 34 having several resistors 35 switched in series. Here, adjustable electronic element 36 is switched in parallel with resistor 35, and is shown as a switching diode 36, to lower the reception level in steps.

Figure 4:
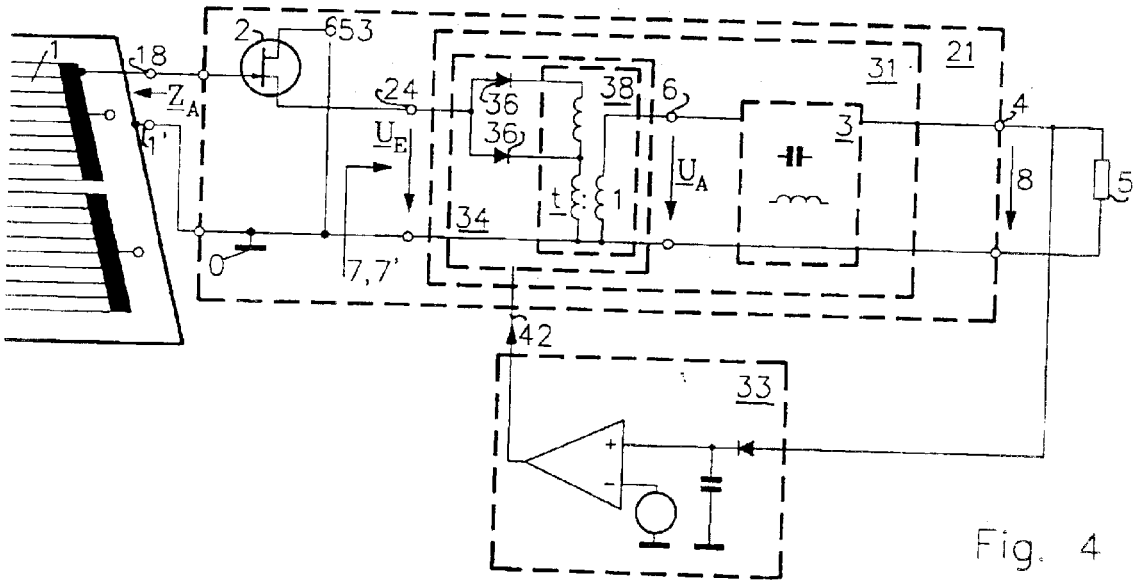
FIG. 4 shows another alternative embodiment of the antenna shown in FIG. 1.

FIG. 4 shows an active broad-band reception antenna as shown in FIGS. 1 and 3, but with an adjustable transformation member 34 consisting of a transformer 38 having a transformer ratio (t) that is provided in steps. Switching diodes 36 serve as adjustable electronic elements 36 for setting a large transformer ratio (t), and thereby a large ratio of the input voltage $U_E$ to the output voltage $U_A$ in the case of large reception levels.

Figures 2A, 2B:
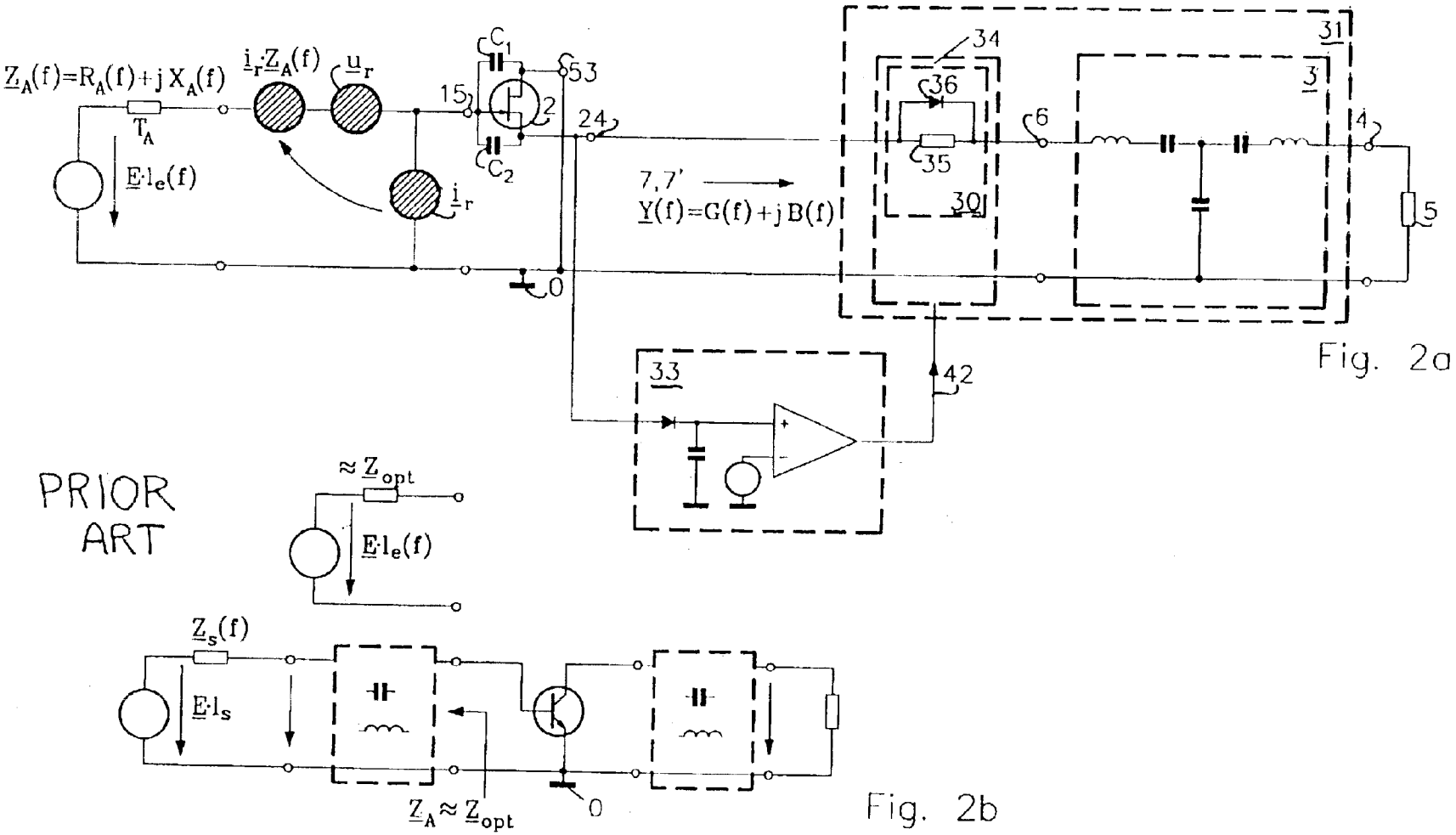
Fig. 2b PRIOR ART
FIG. 2*a* shows the electrical equivalent circuit of an active broad-band reception antenna according to the invention.
FIG. 2*b* shows the electrical equivalent circuit of an active broad-band reception antenna according of the prior art, having a noise adaptation network and an external adaptation network for smoothening out the frequency response.

The method of operation, and the design principle of the antenna according to the invention will be explained using the electrical equivalent circuits of FIGS. 2*a* and 5. FIG. 2*a* shows a circuit having a serial noise voltage source $u_r$ and a parallel noise voltage source $i_r$ that can be ignored in terms of its effect, on a field effect transistor, serving as a three-pole amplification element 2 having a high impendance low-loss filter circuit 3 on the output side, outside of the transformation range. The suitability of a given passive antenna part 1 for the construction of a sufficiently noise-sensitive active antenna can be estimated using the antenna temperature that prevails in the transmission frequency range. As a rule, field effect transistors possess an extremely small parallel noise current source $\underline{i}_r$, so that their contribution $\underline{i}_r * \underline{Z}_A$ is always small enough to be ignored, if the gate source and gate drain capacitances $C_1$ and $C_2$ are small enough to be ignored and at the antenna impedances $\underline{Z}_A$ that occur in practice, in comparison with the serial noise voltage source $\underline{u}_r$ of the field effect transistor, expressed by its equivalent noise resistance $R_a F$. The sensitivity requirement is therefore reduced to having the noise voltage source $u_r^2 = 4kT_o BR_a Fbe$ smaller or at most as great, in relationship to the. received noise voltage source $u_{rA}^2 = 4kT_A B\, R_A$, which is determined by the antenna temperature $T_A$ and the real part $R_A$ of the antenna impedance $\underline{Z}_A$. In the case of equally great noise contributions, only the requirement $$R_A > R_{aF} * T_0 / T_A \tag{1}$$

which can easily be checked, must therefore be met as a sufficient sensitivity criterion, if the capacitances $C_1$, $C_2$ are small enough to be ignored. Modern gallium-arsenide transistors have capacitances $C_1$ and $C_2$ that are small enough to be ignored, in comparison with the rest of the wiring, and an effect of $i_r$ that can be ignored, in view of the planned application, as the cause for the extremely low noise temperature $T_{NO}$ that occurs during noise adaptation of such transistors. The equivalent noise resistance is dependent on the closed-circuit current, and can be estimated as being 30 ohms or less, above 30 MHz, for broad-band use. For an antenna in the VHF range, and an antenna temperature of approximately 10000 K that prevails there, in view of the noise sensitivity, $R_A(f)$>approximately 10 ohms must therefore be required as a sufficient condition within the transmission frequency range, for the real part of the complex antenna impedance, which part represents the radiation resistance with a low-loss field effect transistor 2.

Figure 5:
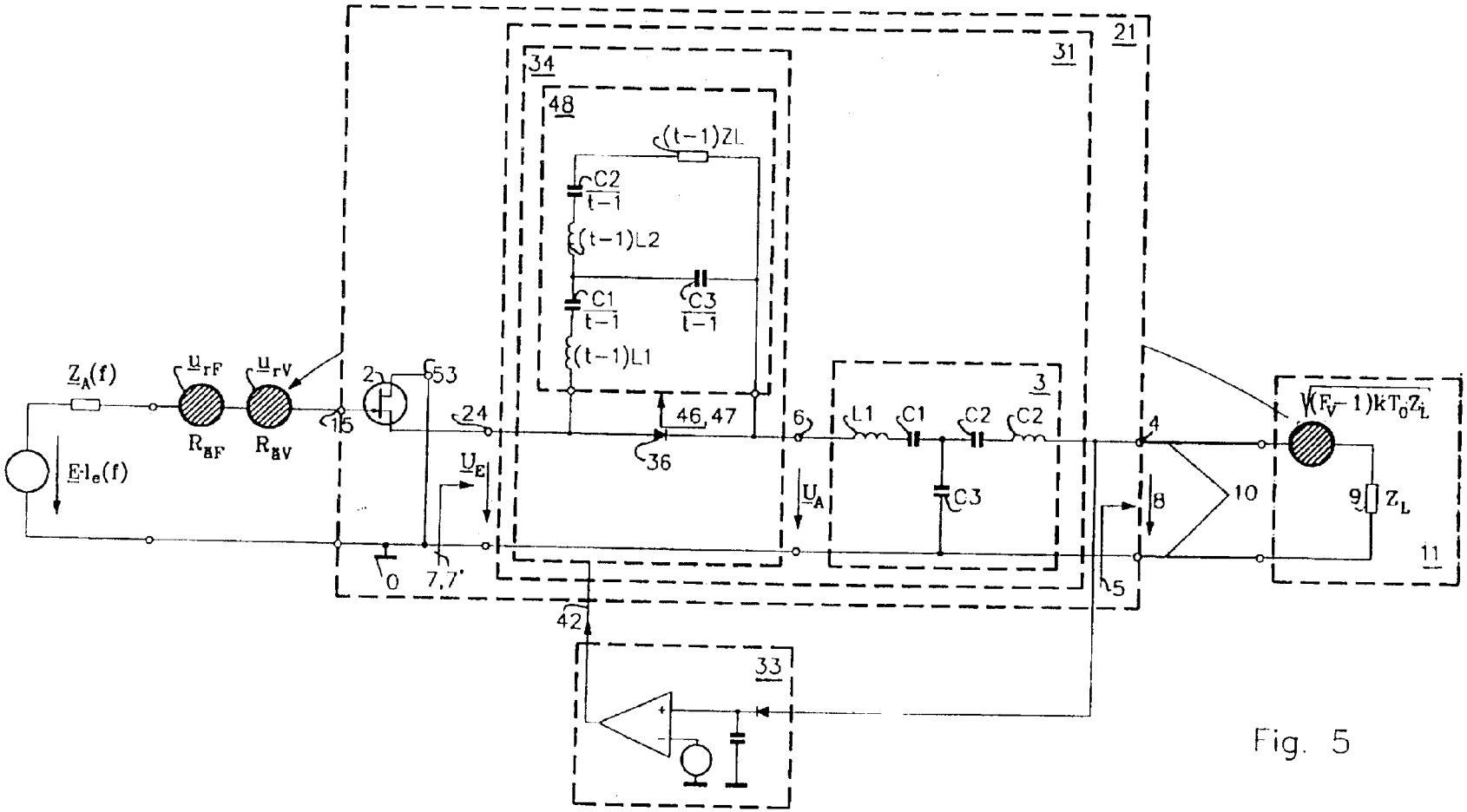
FIG. 5 shows a further alternative embodiment of the invention shown in FIGS. 1, 3, and 4.

FIG. 5 shows an active broad-band reception antenna as in FIGS. 1, 3, and 4, but with an adjustable longitudinal element 30 shown as a frequency-dependent dipole 47, having a dipole admittance 46 that is similar but smaller to input admittance 7 of low-loss filter circuit 3, by a frequency-independent factor (t-1), with a switching diode 36, switched in parallel with the frequency-dependent dipole 47. The antenna of FIG. 5 takes into account the noise contribution of an amplifier unit 11, coupled at the end of high-frequency line 10 connected with low-loss filter circuit 3, on the output side. If there is sufficient amplification in amplifier circuit 21, this noise contribution is kept correspondingly small. In order to protect amplifier unit 11, connected on the load side, from non-linear effects, it is frequently necessary to design the amplifier in a frequency-independent manner, to a great extent, within the transmission frequency range. This is achieved by means of corresponding transformation, preferably a loss-free transformation, of the effective active resistor 5 at the output of low-loss filter circuit 3, into a suitably frequency-dependent input admittance 7. If the frequency dependence required for input admittance 7 on the basis of the frequency dependence of the effective length $l_e(f)$ is known, a circuit composed of reactances can be designed for low-loss filter circuit 3, which meets this requirement, to a large extent.

The criterion, according to the invention for the exemplary design of a necessary and frequency-independent reception line, within the transmission frequency range, is explained using FIG. 5, for terrestrial radio reception of an active vehicle antenna, in view of the reception output in the reception arrangement connected on the load side. Reception that is independent of frequency, to a great extent, is required, in order not to reduce the sensitivity of the overall system by the noise contribution of the reception system connected on the load side of the active antenna, and also to avoid non-linear effects due to excessively high amplification, as a result of the frequency-dependent reception behavior within a transmission frequency range. In FIG. 5, the reception system connected on the load side of the active antenna is represented by the amplifier unit 11 having the noise number $F_v$. Its noise contribution to the total noise is shown as an equivalent noise resistance $R_a$Vat the input of amplifier circuit 21, where the following applies:

$$R_{\ddot{a}v} = \frac{(F_v - 1)}{4 \cdot G(f)} \tag{2}$$

Here, G(f) refers to the frequency-dependent real part of the input admittance 7 of low-loss filter circuit 3. This noise contribution is insignificant, as compared with the unavoidable received noise of the $R_A$ that makes noise at $T_A$, if the following applies:

$$G(f) > \frac{(F_v - 1) \cdot To}{4 \cdot T_A} \cdot \frac{1}{R_A(f)} \tag{3}$$

In order to meet the sensitivity requirement, in an advantageous embodiment of an active antenna according to the invention, the frequency dependence of the real part G(f) of input admittance 7 of low-loss filter circuit 3 must be selected to be reciprocal to the frequency response of the real part $R_A$(f) of the complex antenna impedance. A VHF radio receiver, for example, with $F_v$~4, G(f)<1/(3*$R_A$(f)) should therefore be selected. In order to protect the receiver against overly high reception levels, on the other hand, the amplification output of the active antenna should not be significantly greater than needed to achieve optimal sensitivity of the overall system, and therefore G(f) should be selected approximately at the value as indicated on the right side of the equation (3).

The invention provides the great advantage that the frequency response for G(f) predetermined from $R_A$(f) can therefore be easily fulfilled, because neither the on/off source impedance on the input side of low-loss filter circuit 3, which is indicated as $1/g_m$ of the field effect transistor 2, nor the effective active resistor 5 at the output of low-loss filter circuit 3, possesses any unavoidable significant reactive components. This results in the advantageous freedom of structuring the frequency response of the active antenna, according to the present invention. In contrast to this, in the case of an active antenna according to the prior art, as shown in FIG. 2*b*, the frequency-dependent emitter impedance $\underline{Z}_s$(f) is necessarily and inseparably present, as the source impedance of the primary-side transformation network. Its frequency response limits the achievable band width of the impedance that is transformed into the vicinity of $\underline{Z}_{opt}$, and thereby the band width of the signal-noise ratio at the output of the active circuit is limited.

In the following, the exemplary design of the frequency response of G(f) of an active vehicle antenna according to the invention will be described, where the requirement exists that the reception output $P_a$ at the input of the reception system connected on the load side of the active antenna is greater by a factor V than with a passive reference antenna, for example, a passive rod antenna on the vehicle, at its resonance length. Because of the different directive patterns, this factor is defined in reference to the azimuthal averages under a defined constant elevation angle θ of the wave incidence. By way of comparison, azimuthal coefficients of directivity using an antenna measurement segment with the vehicle point of rotation at the passive antenna part 1, and at the comparison antenna, the following azimuthal averages result for the coefficients of directivity, with N angle steps for a full rotation, and with the coefficient of directivity $D_a(\phi_n, \theta)$ of the given passive antenna part 1 and, corresponding to the coefficient of directivity $D_a(\phi_n, \theta)$ of the passive reference antenna, for the nth angle step, in each case:

$$D_{am}(f) = \frac{1}{N}\sum_{n=1}^{N} Da(\Phi_n, \Theta, f) \tag{4a}$$

i.e. for the reference antenna at the reference frequency:

$$D_{pm} = \frac{1}{N}\sum_{n=1}^{N} D_p(\Phi_n, \Theta) \tag{4b}$$

The reception system connected with the load side of the active antenna, which is represented by amplifier unit 11 in FIG. 5, is generally referenced to the line wave resistance $Z_L$ of the high-frequency line system. The average azimuthal reception output in the load resistor 9 results in the following, if the slope $g_m$ of the input characteristic of the field effect transistor 2 is sufficiently great:

$$P_{am} = \frac{1}{2} \cdot E^2 \cdot l_{em}^2(f) \cdot G(f) \tag{5}$$

whereby $l_{em}^2$(f) represents the azimuthal average of the quadratic effective length of the passive antenna part 1 that occurs at every frequency, taking into consideration the effective area of the passive antenna part 1 that results from $D_{am}$(f) according to Equation 2, as follows:

$$l_{em}^2(f) = \frac{1}{N}\sum_{n=1}^{N} l_{en}^2(f) = \frac{\lambda^2}{\pi} \cdot \frac{R_A(f)}{Z_0} \cdot D_{am}(f) \tag{6}$$

The average azimuthal reception output of the passive reference antenna, at $D_{pm}$ from Equation (5), amounts to the following:

$$P_{pm} = \frac{\lambda^2}{8 \cdot \pi} \cdot \frac{E^2}{Z_0} \cdot D_{pm} \tag{7}$$

Taking into consideration the amplification requirement $P_{am}/P_{pm}$=V, the frequency response for G(f) to be required according to the invention results in:

$$G(f) = \frac{1}{R_A(f)} \cdot \frac{D_{pm}}{D_{am}(f)} \cdot V \tag{8}$$

For the case of a passive antenna part 1 that is subject to losses, having a degree of effectiveness of η, the coefficient of directivity $D_{am}$(f) must be replaced by $D_{am}$(f)*η in Equation (8). The other sizing rules are not changed by this. For the case that the azimuthal averages $D_{pm}$ and $D_{am}$(f) are approximately the same, the frequency dependence of G(f) must be structured to be proportional to $1/R_a$(f). If V is selected to be large enough so that $$\frac{D_{pm}}{D_{am}(f)} \cdot V >> \frac{(F_V - 1) \cdot T_0}{4 \cdot T_A} \tag{9}$$

then the noise contribution of the reception system connected with the load side of the active antenna to the total noise is small enough to be ignored. If, in addition, the condition indicated in Equation (1) is fulfilled, then the sensitivity is exclusively dependent on the directional effect of the passive antenna part 1 and on the prevailing interference incidence. The minimal necessary average azimuthal radiation density $S_{am}$ for a signal-noise ratio=1 then reads:

$$S_{am}(f) = \frac{k \cdot T_A \cdot B}{D_{am}(f)} \cdot \frac{4 \cdot \pi}{\lambda^2} \tag{10}$$

and increases at $1/\eta$, if $D_{am}(f)$ must be replaced by $D_{am}(f)*\eta$.

Taking into consideration the interference radiation that proceeds from the vehicle itself, the selection of a passive antenna part 1 suitable for an antenna according to the invention, as a structure located on the vehicle, can therefore accurately take place, in connection with the condition for $R_A(f)$ indicated in Equation (1) and is discussed in greater detail in the following, in that the ratio $T_A/D_{am}(f)$ is established at a sufficiently large value for the transmission frequency range.

Figure 18A:
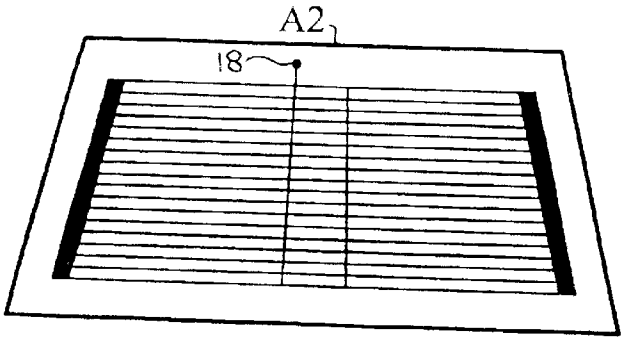
FIGS. 18*a* and 18*b* show examples of antenna configurations of possible passive antenna parts 1.
Figure 18B:
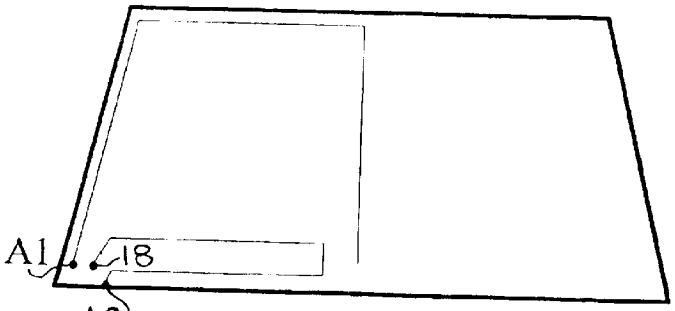
Figure 18C:
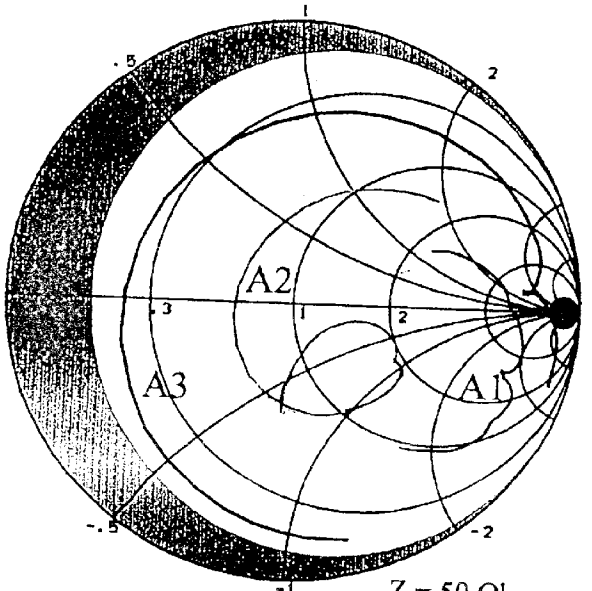
FIG. 18*c* shows an impedance diagram for antenna structures A1, A2, and A3 in the impedance plane in the frequency range from 76 to 108 MHz, and cross-hatched regions for $R_A<R_{Amin}$ and $R_A>_{Ramax}$.
Figure 18D:
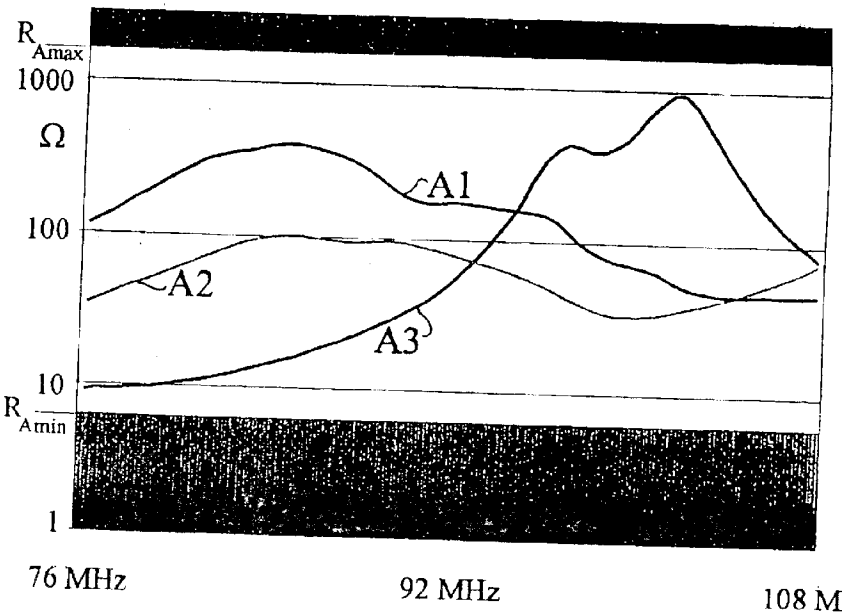
FIG. 18*d* shows real parts of the antenna impedances according to FIG. 18(*c*) with the permissible value range $R_{Amin}<R_A<R_{Amax}$.

FIGS. 18*a* and 18*b* show exemplary antenna configurations of possible passive antenna parts 1 of active antennas according to the invention. At the connection points 18, the impedance progressions $\underline{Z}_A(f)$ shown in the complex impedance plane of FIG. 18*c* are present, as a function of the frequency. The region indicated with cross-hatching, at the left margin of the diagram, is bordered on one side by the value $R_{Amin}$=const. Impedance progressions that run outside of the region marked in this way thereby fulfill the condition required according to Equation (1), that the noise of the field effect transistor 2 can be ignored if a certain interference incidence according to $T_A$ is present. The diagram convincingly shows the advantage of an active antenna according to the invention as compared with a prior art an active antenna according to FIG. 2*b*, which lies in the fact that without any adaptation means on the input side, all of the antenna structures fulfill this condition, without transformation means on the input side. FIG. 18*c* plots the real parts of the passive antenna parts 1 shown in FIGS. 18*a* and *b* for the frequency from 76 to 108 MHz. The frequency response of the real part of the input admittance 7 to be designed according to the invention, at the input of low-loss filter circuit 3, must therefore be structured inverted to the curve progressions as shown in FIG. 18*d*, according to aspects such as those explained in connection with Equations (3) and (8).

For the amplifier circuit 21 according to the invention, there is also an upper limit for the value of the voltage at the input that can be tolerated; in the reception field, this voltage results by way of the effective length $l_e$. The maximum tolerated voltage can be increased by means by selecting a suitable field effect transistor 2, and by means selecting a suitable working point, as well as by means of other known wiring measures. According to Equation (6), a maximum tolerated effective portion $R_{Amax}$ can be assigned to a maximum tolerated azimuthal average $l_{em}$, if the azimuthal coefficient of directivity $D_{am}(f)$ is known. The value range permissible for sizing, at $R_A>R_{Amax}$, is also marked with cross-hatching in FIGS. 18*c* and 18*d*. The radiation resistances $R_A$ of the impedance values of particularly advantageous structures for use as a passive antenna part 1 therefore lie outside of the cross-hatched value range, at $R_{Amin}<R_A<R_{Amax}$.

Figure 17:
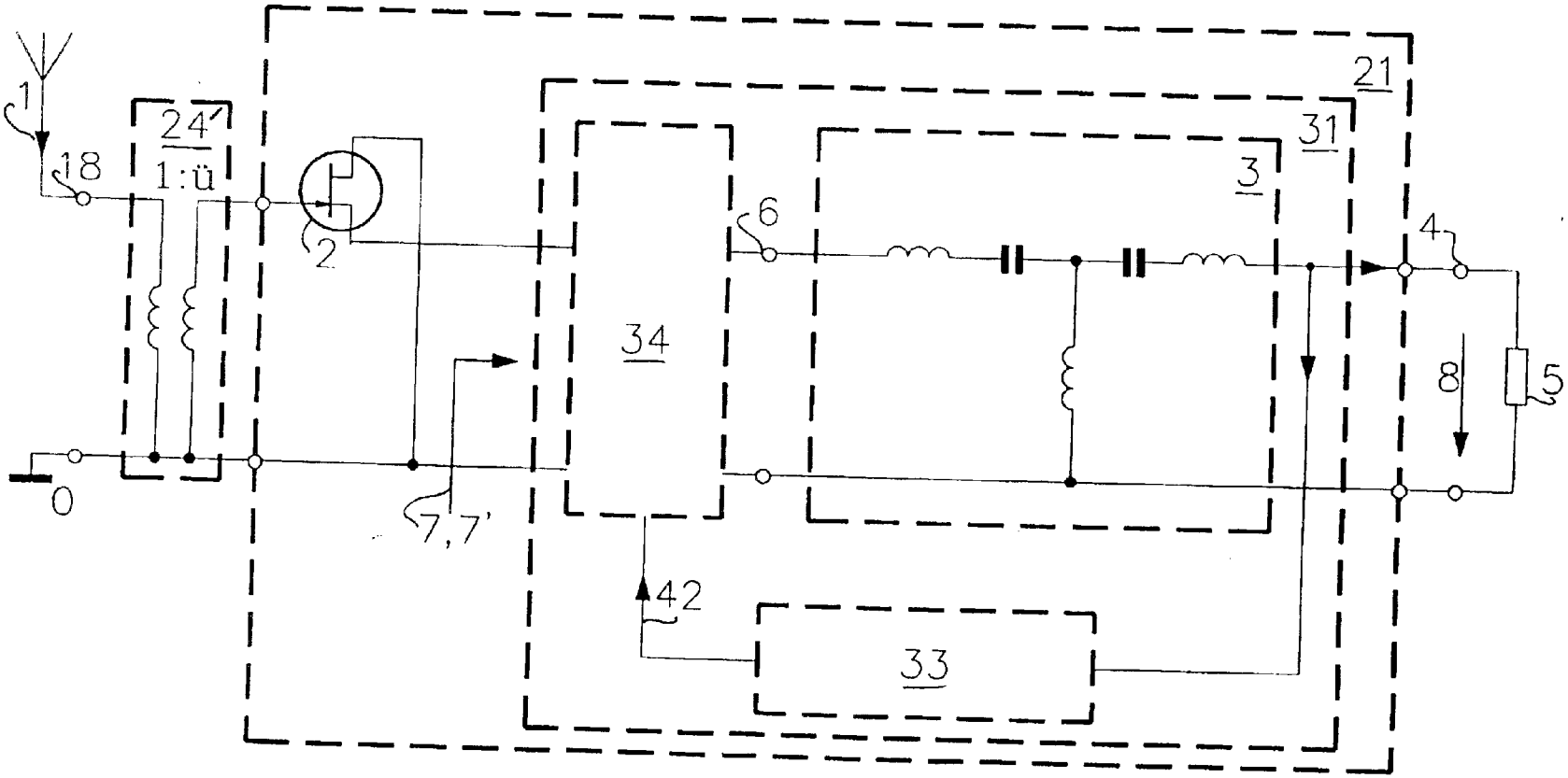
FIG. 17 shows another active antenna circuit according to the invention.

FIG. 17 shows another advantageous embodiment of the invention, where a given antenna structure is supplemented, by means of the use of a low-loss transformer having a transformer the translation ratio ü, which transformer forms the passive antenna part 1, together with the antenna structure, e.g. a heating field on the window. Here, transformer 24' has a sufficiently high impedance primary inductance, and a sufficiently large transformer ratio for providing a broad-band increase in the effective length $l_e$. It is advantageous if the broad-band transformer ratio is selected so that the impedance that can be measured at the output of the transformer is placed in the value range $R_{Amin}<R_A<R_{Amax}$ with its real part. In this connection, it is advantageous to design the primary inductance with a sufficiently high impedance.

The linearity requirement is fulfilled by a sufficiently large counter-coupling, by means of input admittance 7 located in the source line. This requires comparatively low counter-coupling in the transmission range, which is sized according to the amplification requirement, e.g. according to Equation (8), but which is made as great as possible outside of the transmission range. In an advantageous development of the invention, T-half-filters or T-filters, or chain circuits of such filters, are used to implement such low-loss filter circuits 3. These filters are shown in the figures, in their basic structure. In order to correspond to a complicated frequency progression of G(f), the individual elements can be supplemented with additional reactive elements. In the interests of having a high impedance on the input side, and a stop-band effect in the block-band range, it is practical to form the serial and parallel branch, respectively, with a combination of reactive resistors, in each instance, in such a way that both the absolute value of a reactive resistor, so that both the absolute value of a reactive resistor in serial branch 28, and the absolute value of a reactive resistor in parallel branch 29 are sufficiently small, within a preferred transmission frequency range, and sufficiently large outside such a range (FIG. 19*b*).

In another advantageous use of the invention, it is appropriate basic structures for low-loss filter circuits 3 can be first stored in a model digital computer, for different characteristic progressions of G(f), with unknown values for the reactive elements. Then, both the impedance $\underline{Z}_A$ of the passive antenna part 1 can be determined by means of measurement technology, and the azimuthal average $D_{am}$ of the coefficient of directivity can be calculated by means of measurement technology, and stored in the digital computer. The frequency response of G(f) thereby determined according to Equation (8) allows a subsequent concrete determination of the reactive elements for the low-loss filter circuit for a suitably selected basic filter structure using known strategies of variation calculations for the given amplification V of the active antenna.

Figure 6:
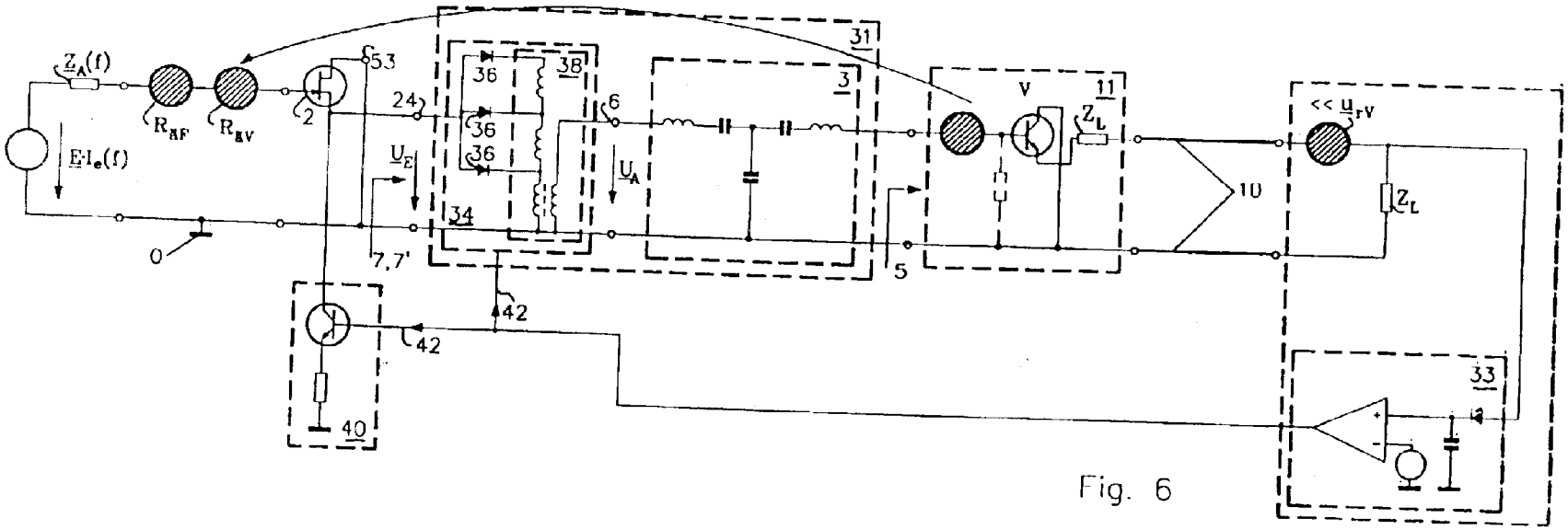
FIG. 6 shows still another alternative embodiment of the invention.

In the case of those antenna systems in which several antennas are formed, such as, for example, for antenna diversity systems or group antenna systems, or multi-range antenna systems, it is helpful, in an advantageous further development of the invention, as indicated in FIG. 6, to structure amplifier unit 11 as an active output stage of amplifier circuit 21. FIG. 6 shows another alternative of the invention, with a broad-band reception antenna as in FIG. 4, having an amplifier unit 11 with the noise number $F_v$ as a circuit that passes the signal on; construction of the real part G of admittance 7 that is active at small reception levels has to be sufficiently large so that the noise contribution of amplifier unit 11 is smaller than the noise contribution of field effect transistor 2. This stage can be provided with an output resistor similar to wave resistor $Z_L$ of conventional coaxial lines. In this connection, the effective active resistor 5 is formed by the input impedance of amplifier unit 11. Analogous to the above explanations, G(f) must be designed using a low-loss filter circuit 3 that has this impedance on its output.

Because of the lack of effect of the adjustable transformation member 34 for low reception levels, the sensitivity of the system is not negatively affected. The voltage reduction after the first amplifying element of the active antenna is advantageous, in particular, because it permits an optimal effect with regard to the frequency dependence of the intermodulation interference to be expected. The influence on the sensitivity of the entire reception system is thereby determined only by the influence of the noise number of the circuit connected on the load side, increased by the voltage reduction.

In the following, different forms of reducing the internal amplification of the active antenna will be compared. In FIGS. 1, 2*a* and 3, voltage reduction takes place by way of a series element 30, which is structured to be frequency-independent. Subsequently, reception signals at frequencies at which low-ohm real parts of the antenna impedances are present and therefore, according to the invention, large values of the input admittance G(f) are formed, are thus attenuated more strongly than reception signals at frequencies having a high-ohm real part of the antenna impedances. When a frequency-independent series element 30 is used, an average resistance value must therefore be selected for reducing the voltage at high reception levels, which value is too small for intermodulating reception signals at frequencies having a large real part of the antenna impedances, and too large for frequencies having a small real part of the antenna impedances. There is a risk that the intermodulating reception signals at frequencies having a large part of the antenna impedances will cause excessively large intermodulation interference, because the counter-coupling effect is smaller. On the other hand, the remaining amplification at frequencies having a small real part of the antenna impedances will be too small, and the arrangement will be insufficiently sensitive at these frequencies.

In an advantageous embodiment of the invention, various types of adjustable transformation members 34 are therefore provided that lower admittances 7 that are set at low reception levels by a suitable factor, independent of frequency. For the amplifier components currently available, for example, a voltage level reduction of between 20*log (t)=10 dB and 20*log(t)=20 dB is practical for the VHF range and use in a motor vehicle. In this way, the internal amplification of the active antenna is reduced by a desired factor, independent of frequency, and the aforementioned frequency-dependent intermodulation effect does not occur. According to the invention, this is achieved, for example, by means of a transformer arrangement as shown in FIGS. 4 and 6.

For this purpose, the frequency-independent translation ratio of the transformer is structured to be adjustable in steps, using divided coils and the switching diodes 36 that are shown, as adjustable electronic elements 32. If the translation ratios are chosen correctly, the suitable values for the active admittance G(f) can be selected in the admittance 7 or 7', respectively, for the range of small or large reception levels, respectively. To increase the linearity and the current modulation range of three-pole amplification element 2, the closed-circuit current in this element of FIG. 6 can be increased, together with the reduction of the internal amplification of the active antenna.

Another method for providing frequency-independent counter-coupling can be performed by the arrangement in FIG. 5. Here, adjustable series connected element 30 is provided as a frequency-dependent dipole 47, for a frequency-independent reduction of the high-frequency reception signals 8. This dipole is designed with a dipole admittance 46 similar to the input admittance 7 of low-loss filter circuit 3, but essentially smaller by a frequency-independent factor t-1 than input admittance 7 of transformation network 31 at low reception levels. By switching a switching diode 36 in parallel with the frequency-dependent dipole 47 which, if set in the cut-off state, causes the dipole admittance 46 to be effective and, if set in the through state, causes the dipole admittance 46 to be bridged, there is a reduction of high-frequency reception signals 8 by a factor $t=U_E/U_A$ that is essentially independent of frequency, when switching diode 36 is cut off.

Figure 8:
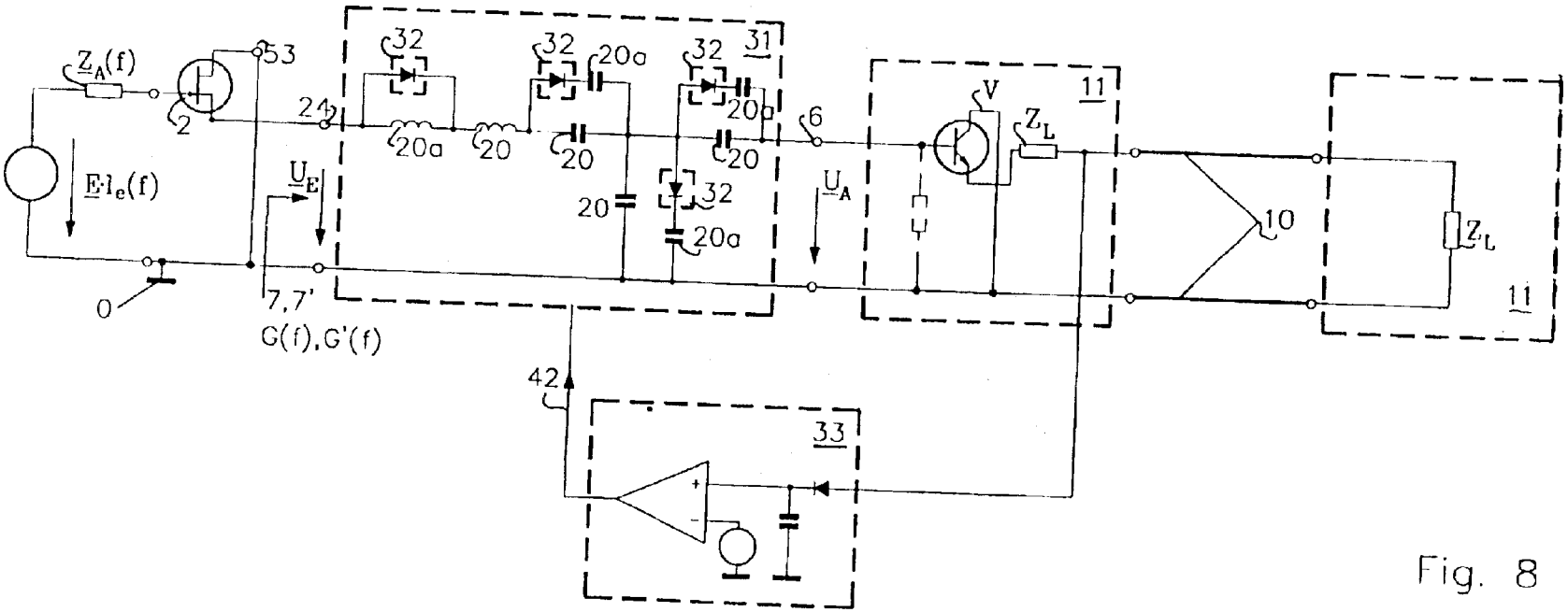
FIG. 8 shows an alternative embodiment of the active broad-band reception antenna as in FIG. 6.

FIG. 8 shows another advantageous further development of the invention, where transformation network 31 acts as a filter, and is structured as a low-loss filter circuit 3 having reactive elements 20 with a fixed setting. FIG. 8 shows an alternative embodiment of the antenna in FIG. 6, but with a filter circuit 3 having permanently set reactive elements 20 and reactive elements 20*a*, which are switched on and off using adjustable electronic elements 32, to lower the internal amplification. Here, reactive elements 20*a* that can be turned on are used. They are turned on and off using adjustable electronic elements 32, so that if the value goes below a predetermined input level, the desired frequency dependence of the greater active admittance G(f) of the input admittance 7 that is effective at the source connector 24, is present for a larger internal amplification of the active antenna, on the one hand. On the other hand, if the value goes above a predetermined reception level, the desired frequency dependence of the input admittance 7' that is effective at source connector 24, corresponding to the reduced active admittance G'(f) having the same frequency dependence, is set for reduced internal amplification of the active antenna.

Figure 7:
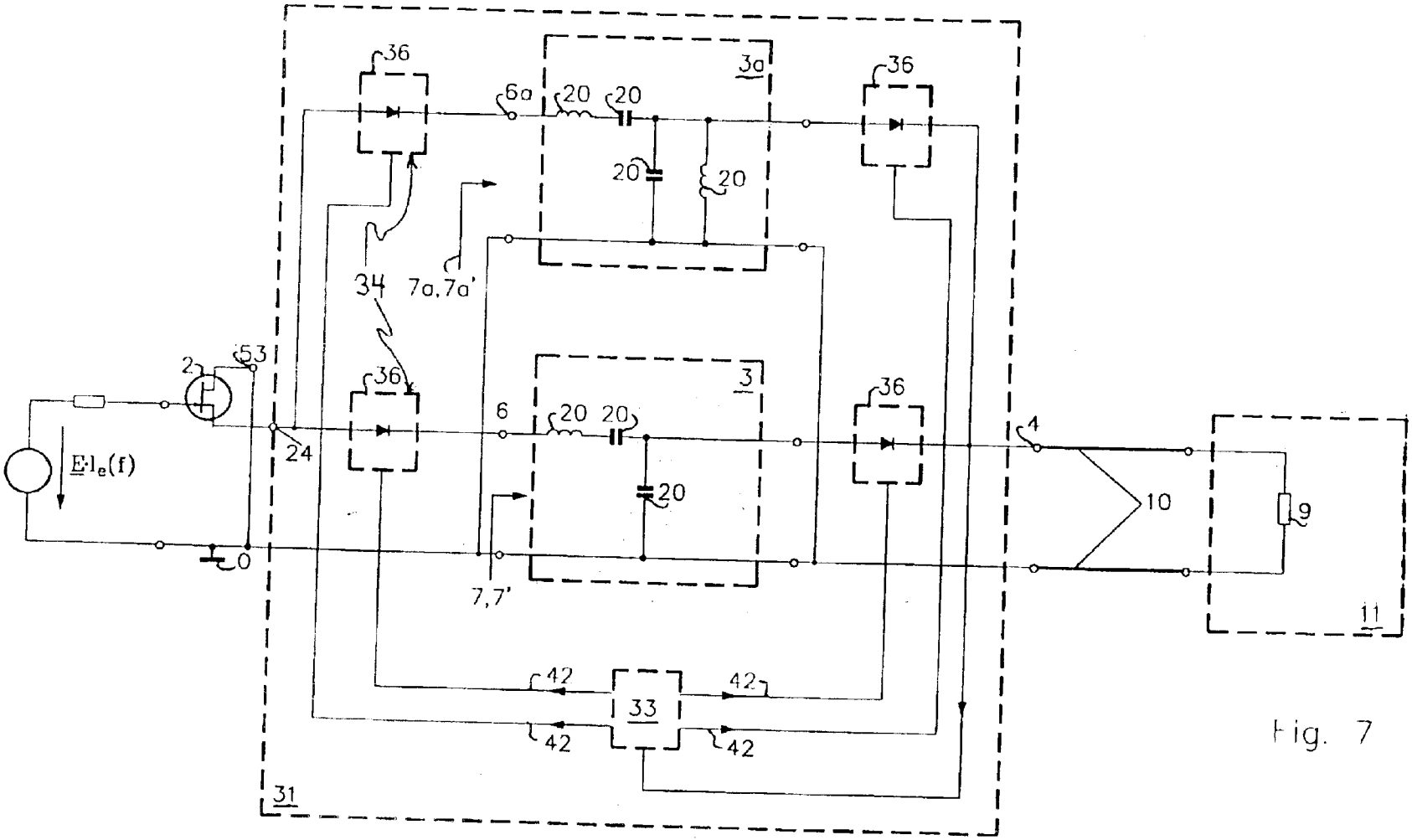
FIG. 7 shows another active broad-band reception antenna as in FIG. 2*a;*

FIG. 7 shows another alternative embodiment of the antenna, having several low-loss filter circuits, which are alternatively switched on and off between the input and the output of transformation network 31 using switching diodes 36, for alternative reduction of the internal amplification of the active antenna. In transformation network 31 shown in the advantageous arrangement in FIG. 7, several low-loss filter circuits 3, 3*a* are present, which are alternatively switched between the input and the output of transformation network 31, by way of switching diodes 36. Their input admittances 7, 7*b* for low reception levels and 7', 7*b'* for high reception levels, respectively, are formed with reactive elements 20 having a fixed setting, in each instance so that using switching diodes 36, if the value goes below a predetermined reception level, the desired frequency dependence of the active admittance G(f) of input admittance 7 that is effective at the source connector 24 exists, for greater internal amplification of the active antenna. Moreover, if the value goes above a predetermined reception level, the desired frequency dependence of the active admittance G'(f) of input admittance 7' that is effective at source connector 24 exists, for reduced internal amplification of the active antenna.

Figure 10:
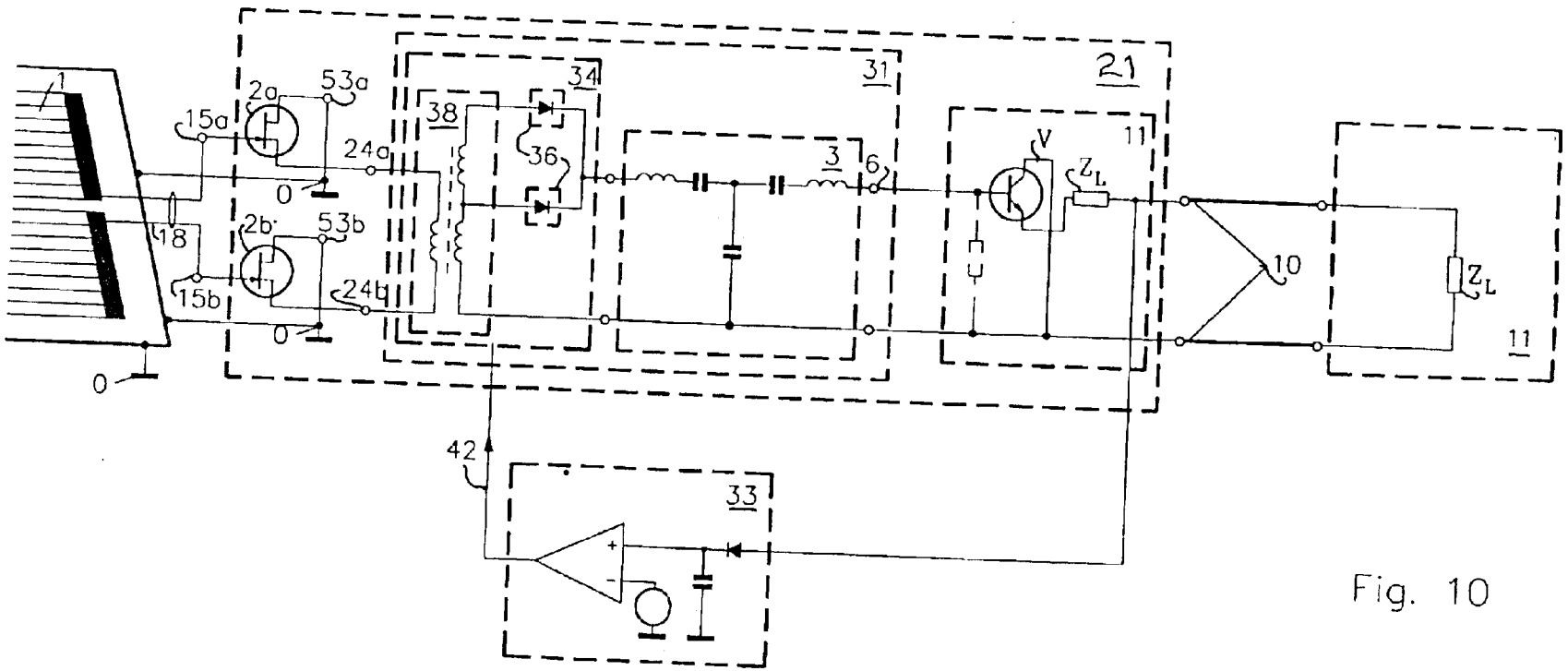
FIG. 10 shows a passive antenna part according to the invention.

In FIG. 10, there is shown an embodiment of an active antenna according to the invention wherein the passive antenna part 1 has a connection point 18, the two connectors of which are at a high value relative to the ground connection. There is provided a field effect transistor 2*a*, and another field effect transistor 2*b*, and a transformer 38 structured as an isolating transformer, with switching diodes 36 at its output for setting the transformer ratio. The antenna has a connection point 18, the two connectors of which are at a high potential as compared with ground 0. Each of the two connectors is connected with one control connection 15*a* and 15*b*, respectively, of a three-pole amplification element 2. The source connectors 24*a* and 24*b* are connected to the primary side of the transformer 38 serving as an isolation transformer, the secondary side of which possesses different outputs for providing different transformer ratios t. The adjustable transformation member 34 is therefore formed by transformer 38 and switching diodes 36. Connectors 53*a* and 53*b* of three-pole amplification elements 2*a* and 2*b*, respectively, are connected with ground 0.

Figure 9:
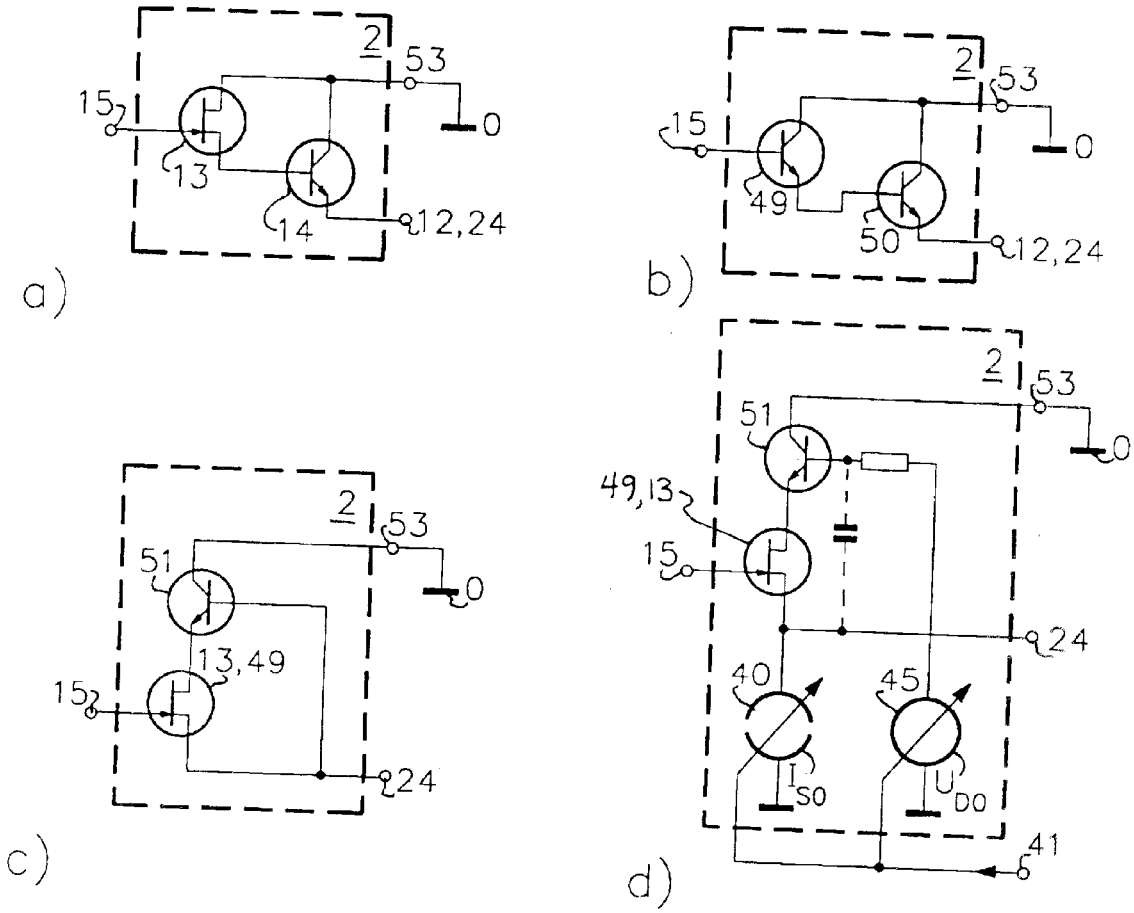
FIGS. 9*a*–9*d* show four designs of the three-pole amplification element as an expanded three-pole amplification element.

FIG. 9*a* shows another advantageous embodiment of the invention, wherein three-pole amplification element 2, is an expanded three-pole amplification element for several frequency ranges. In order to increase the effective steepness of the transformation characteristic, the expanded element is combined from an input field effect transistor 13; the source of the latter switches on a bipolar transistor 14, in an emitter follower circuit, and its emitter connector 12 forms the source electrode of the expanded three-pole amplification element 2.

In another advantageous embodiment, the three-pole amplification element 2 in FIG. 9*b* is combined from an input bipolar transistor 49 and another bipolar transistor 50 in an emitter follower circuit. The emitter connector 12 of the bipolar transistor 50 forms the source connector 24 of the three-pole amplification element 2. If the closed-circuit current is set to be sufficiently small in the input bipolar resistor 49, the required high ohm state is achieved at a low input capacitance and a sufficiently small parallel noise current. A significantly greater set closed-circuit current in the further bipolar transistor 50 causes a sufficiently large steepness of the transmission characteristic for the entire element.

In FIG. 9*c*, three-pole amplification element 2 is structured as an expanded three-pole amplification element formed from an input bipolar transistor 49 and an input field effect transistor 13, respectively, whose collector connector and drain connector, respectively, is connected with the source connector and the emitter connector, respectively, of an additional transistor 51, and whose base connector and gate connector, respectively, is connected with the emitter connector and the source connector, respectively, of input bipolar transistor 49 and input field effect transistor 13, respectively. Source connector 24 of three-pole amplification element 2 is formed by this connector. An expanded three-pole amplification element of this form prevents the interference influence of a voltage-dependent capacitance between the control electrode and the drain and collector electrode, respectively, by means of voltage compensation.

In FIG. 9*d*, three-pole amplification element 2 is designed as an expanded three-pole amplification element in which an electronically controllable closed-circuit current source $I_{SO}$ or/and an electronically controllable closed-circuit voltage source $U_{DO}$ is present. In this way, if high reception levels occur, the closed-circuit current $I_{SO}$ or/and the closed-circuit voltage $U_{DO}$ in input bipolar transistor 49 or in the input field effect transistor 13, respectively, is set higher in connection with the lowering of the internal amplification of the active antenna because of overly high reception levels, according to the invention.

Figure 11:
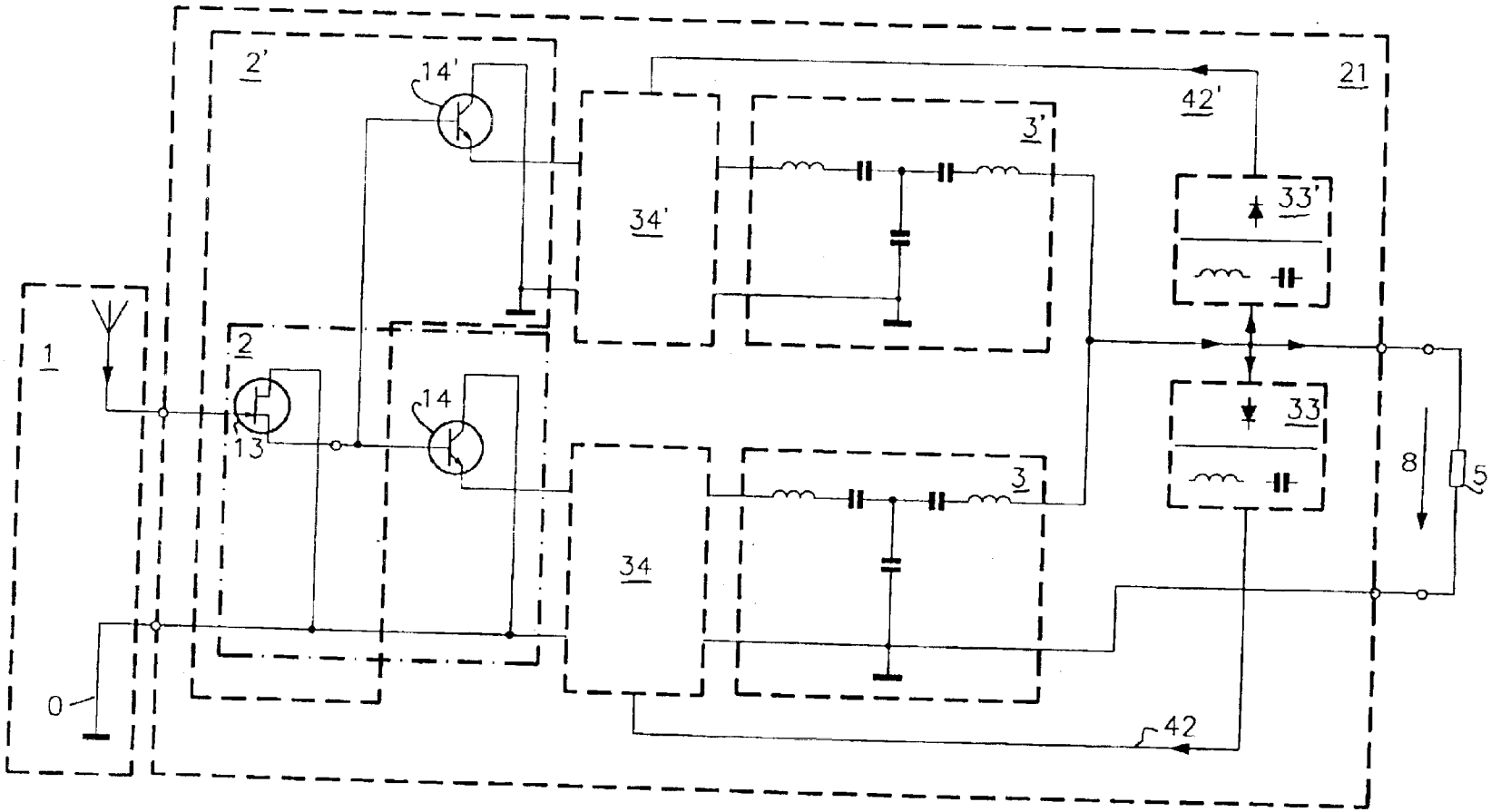
FIG. 11 shows a circuit design of several transmission frequency bands.
Figure 12:
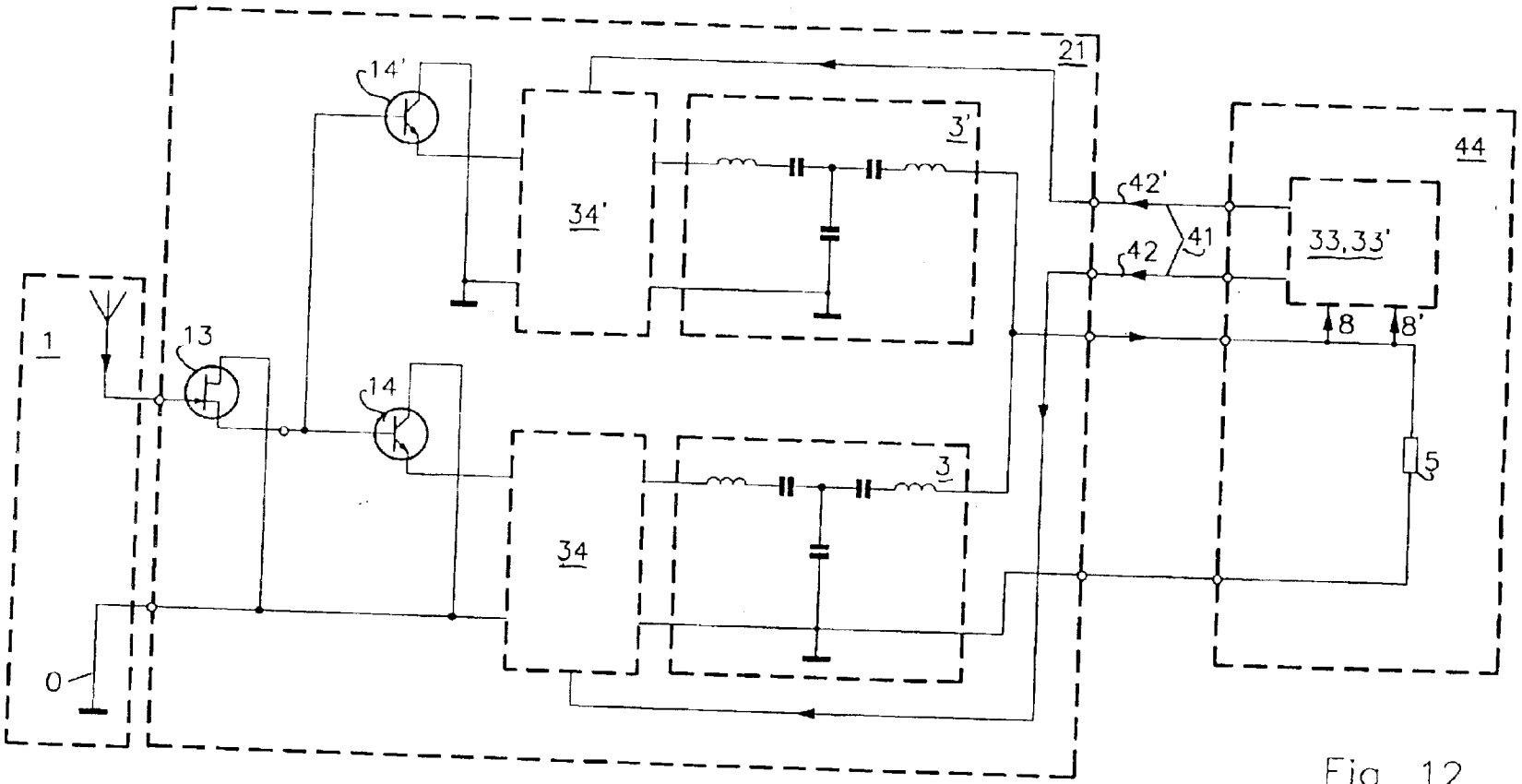
FIG. 12 show an alternative circuit to the arrangement of FIG. 11.

FIG. 11 shows the design of several transmission frequency bands by way of several separate transmission paths for the frequency bands in question. In each instance, an adjustable transformation member 34, 34' and a control amplifier 33, 33' are assigned to each of the transmission paths, in frequency-selective manner. In order to provide several transmission frequency bands, several bipolar transistors 14, 14' are present in FIG. 11, to expand the three-pole amplification element 2, and to form several three-pole amplification elements 2, 2' by combining them. The base electrodes are connected with the source electrode of a common input transistor 13, and with the source connector of an expanded three-pole amplification element according to FIGS. 9*a* to 9*d*, respectively. The bipolar transistors 14, 14' are each connected with the input of a low-loss filter circuit 3, 3', in an emitter follower circuit, to form separate transmission paths for the frequency bands in question. In each of the transmission paths, there is an adjustable transformation member 34, 34', and a control amplifier 33, 33', in each instance, and only the frequency band assigned to the transmission path in question is passed to the latter from the high-frequency reception signal 8, by way of filter measures. The control signal 42, 42' is passed to the assigned adjustable transformation member 34, 34', in each instance. FIG. 12 shows the circuit arrangements as in FIG. 11, but with control amplifiers 33, 33' in receiver 44 that are selectively switched on and off, to switch adjustable transformation members 34, 34' in the active antenna on and off. In contrast to FIG. 11, the control signals 42, 42' are derived from the output signal of the active antenna by means of selection means and control amplifiers 33, 33' in receiver 44 and fed back to the active antenna by way of control lines 41.

Figure 13:
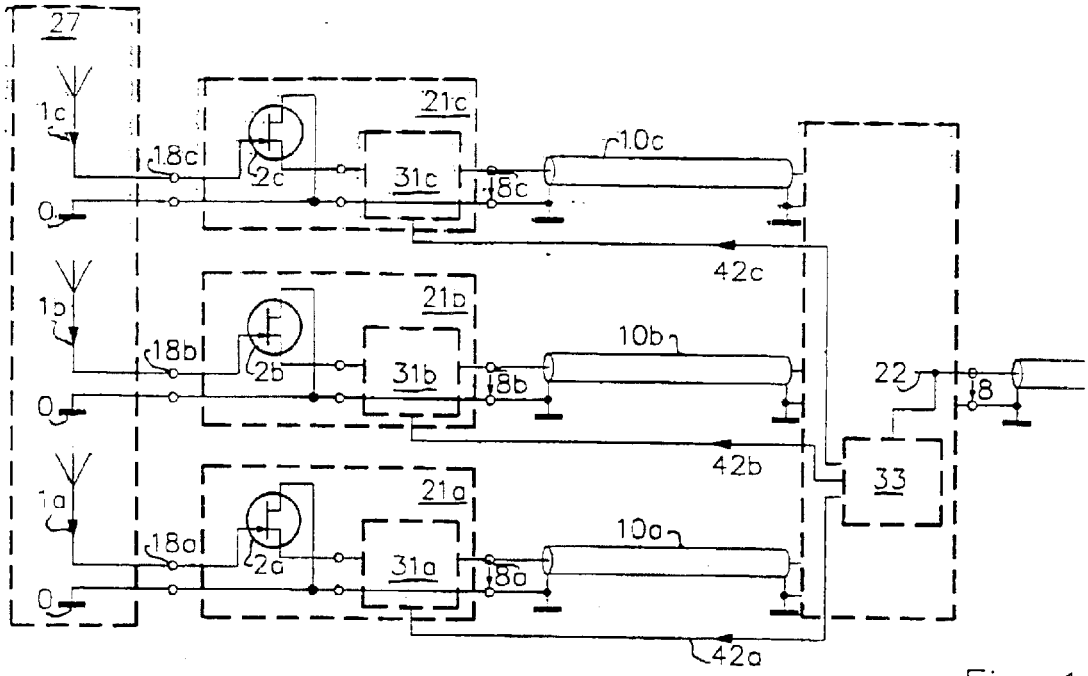
FIG. 13 shows a group antenna system for structuring directional effects according to the invention.

FIG. 13 shows a group antenna for structuring directional effects, having a passive antenna arrangement 27 with electrical passive coupling between the connection points 18, which are each wired together with an amplifier circuit 21*a, b, c* and a high-frequency line 10*a, b* and *c*. The signals 8*a*, 8*b*, 8*c* are brought together in an antenna combiner 22. A common control amplifier 33, for monitoring the high-frequency reception signal 8 is present at the antenna output. This is a particularly advantageous embodiment of the invention, in which the present active antenna is used several times in an antenna system, the passive antenna parts 1 of which possess directional diagrams having the effective lengths $l_e$. These directional diagrams are frequency-dependent and differ, with regard to the incident waves, by amount, or only in phase, but are in electromagnetic radiation coupling with one another and together form a passive antenna arrangement 27 having several connection points 18*a, b, c*. According to the invention, each one of these points has an amplifier circuit 21 connected with it, and is supplemented to form an active antenna. Because of the high impedance status of the amplifier inputs, no noticeable reciprocal influence of the reception voltages is present, because of the uncoupling of the high-frequency reception signals 8 at the passive antenna parts 1. In the circuit of FIG. 13, the reception signals 8*a, b, c*, that are present at the output of the amplifier circuits 21*a, b, c*, are superimposed on the high-frequency reception signals that are present at the passive antenna parts 1, weighted by amount and phase, in an antenna combiner 22 that is present for this purpose, in order to structure a group antenna arrangement having predetermined reception properties with respect to directional effect and antenna gain, without feedback. There, it is advantageous if a common control amplifier 33 provides control signals 42*a, b, c* which are fed back to transformation networks 31*a, b, c* in the active antennas, to lower the totaled high-frequency reception signal 8, so as to perform level monitoring. In another advantageous embodiment of such a group antenna arrangement, level monitoring and attenuation takes place separately in every active antenna, using a control amplifier 33 that is housed there.

Figure 14:
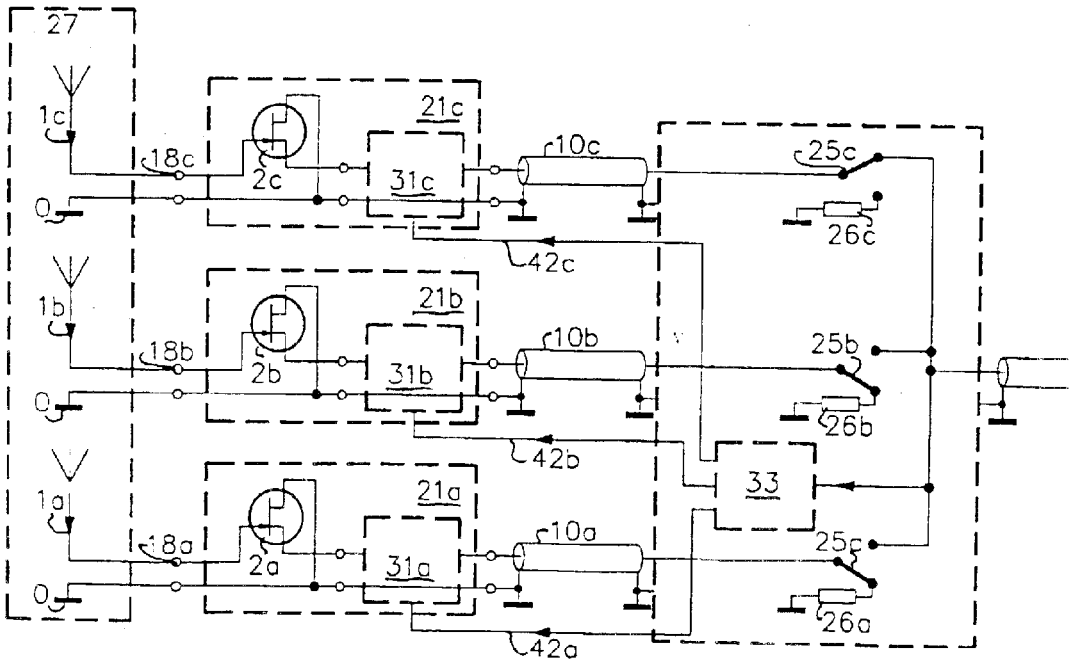
FIG. 14 shows a scanning diversity antenna system having an alternative arrangement from that shown in FIG. 13.

FIG. 14 shows a scanning diversity antenna system as in FIG. 13, but with electronic change-over switches 25 in place of antenna combiner 22, and substitute load resistors 26*a*, 26*b* and 26*c*, in each instance, for placing a load on the antenna branches that are not switched through. A common control amplifier 33 is provided for monitoring the selected high-frequency reception signal.

When an antenna according to the invention is used as an active window antenna, it is possible to invisibly house amplifier circuit 21 in the very narrow edge region of the vehicle window. Therefore, the part to be affixed at its connection point 18 is designed in a miniaturized manner, and only the functionally necessary parts of amplifier circuit 21 are affixed there. The other parts of low-loss filter circuit 3 are placed at a different location, and are wired in via high-frequency line 10.

Figure 19A:
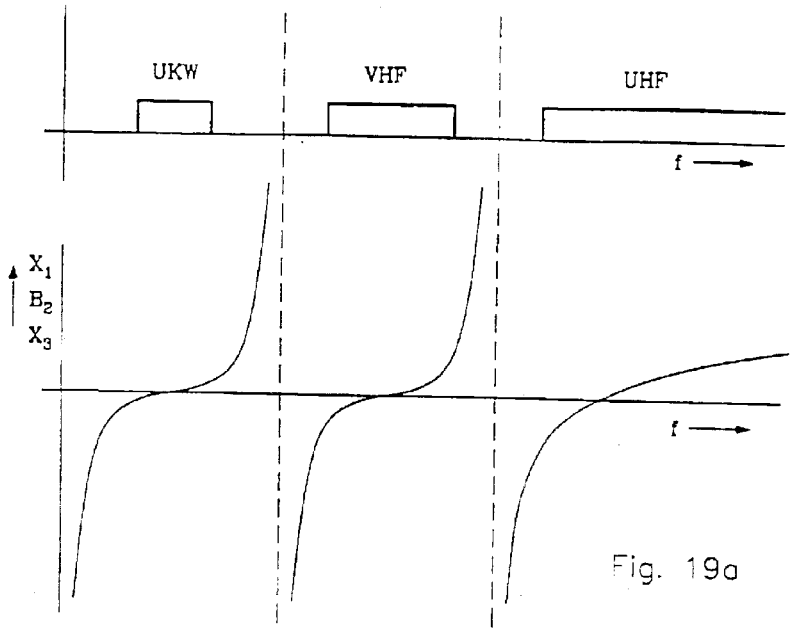
FIG. 19*a* is a chart of the serial reactances $X_1$ and $X_3$ as well as the parallel susceptance $B_2$ of the T-filter arrangement according of FIG. 6*b* above the frequency, using the example of broad-band coverage of the radio ranges of VHF radio broadcasting as well as VHF and UHF television broadcasting; and, FIG. 19*b* shows an electrical equivalent circuit of an antenna according to the invention for the frequency ranges indicated in FIG. 19*a*.
Figure 19B:
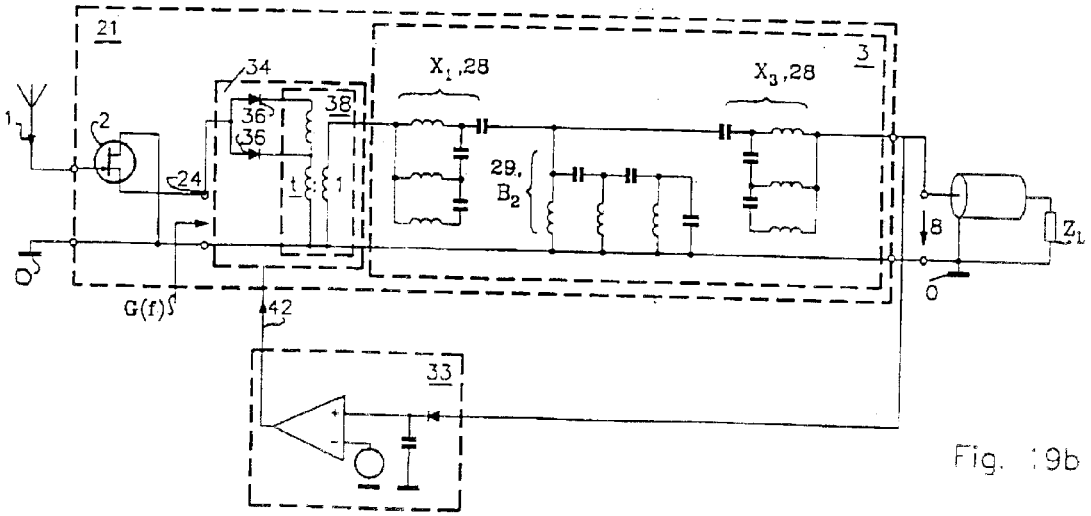

FIG. 19*a* shows the fundamental frequency progressions of reactive resistors $X_1$, $X_3$, or the susceptance $B_2$ of a T-filter arrangement of low-loss filter circuit 3 shown in FIG. 19*b*, as examples, for the frequency ranges of VHF radio broadcasting as well as VHF and UHF television broadcasting. Here, the T-filter configuration provides a high impedance on the input side of low-loss filter circuit 3, in order to achieve sufficiently high counter-coupling of field effect transistor 2 in the cut-off regions. Low-loss filter circuit 3 is structured as a T-half-filter, or T-filter, or as a chain circuit of these filters. The serial or parallel branch, respectively is formed from a combination of reactive resistors, so that both the absolute value of a reactive resistor in serial branch 28, and the absolute value of a susceptance in parallel branch 29 is sufficiently small within a transmission frequency range, and sufficiently large outside this range. The high-frequency reception signal 8 is passed to control amplifier 33 at the output, and adjustable transformation member 34 is controlled by its control signal 42.

To compensate for the effects of non-linearity of an even order, and for the resulting interband frequency conversions in amplifier circuit 21 that result from it, in another advantageous embodiment of the invention, in addition to field effect transistor 2, another field effect transistor 2 having the same electrical properties is used. Here, the input connectors of amplifier circuit 21 are formed by the two control connectors of the field effect transistors 15*a* and 15*b*, and the input of low-loss filter circuit 3 is connected with source connectors 19*a* and 19*b*. A rebalancing member in low-loss filter circuit 3 serves for rebalancing of high-frequency reception signals 8. This circuit can advantageously be connected to a connection point 18 having two connectors that lead to ground, as well.

The efficiency of antenna diversity systems is determined by the number of available antenna signals that are independent of one another in terms of diversity. This independence is expressed in the correlation factor between the reception voltages that occur in a Rayleigh wave field during travel. In a particularly advantageous further development of the invention, several active reception antennas are used in an antenna diversity system for vehicles. The passive antenna parts 1 are selected so that their reception signals $E^*l_e$ that are present in a Rayleigh reception field in no-load operation are as independent of one another as possible, in terms of diversity. These systems, in which connection points 18 have been selected from this aspect and taking vehicle technology aspects into consideration, are shown as examples in FIGS. 15 and 16.

Figure 15:
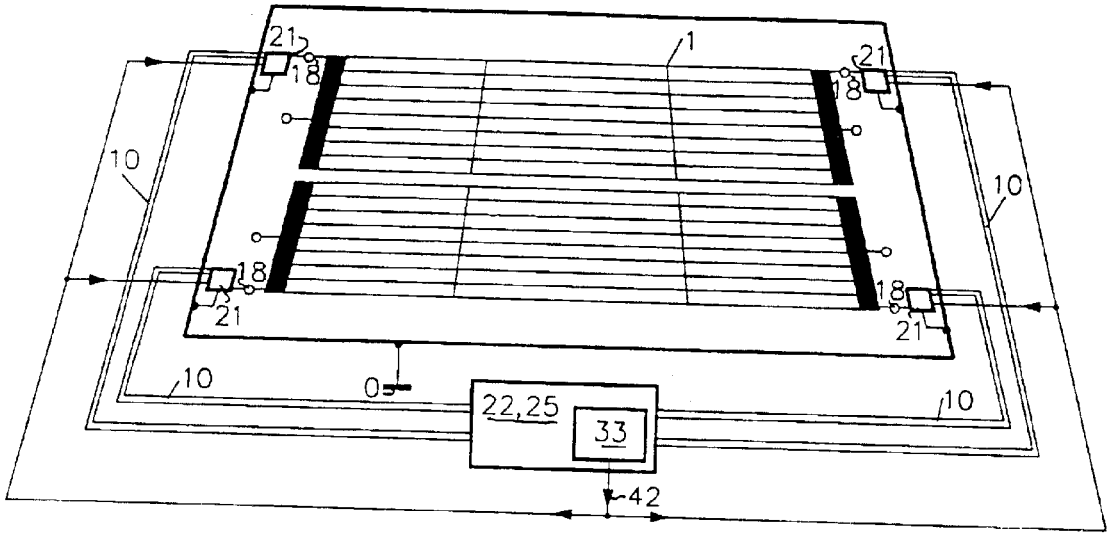
FIG. 15 shows a scanning diversity antenna system formed from heating fields printed onto a vehicle window.

FIG. 15 shows a scanning diversity antenna system with connection points 18 suitably positioned for diversity, to provide reception signals 8 that are independent in terms of diversity. A common control amplifier 33 is present in an electronic change-over switch 25, for monitoring the selected high-frequency reception signal.

Figure 16:
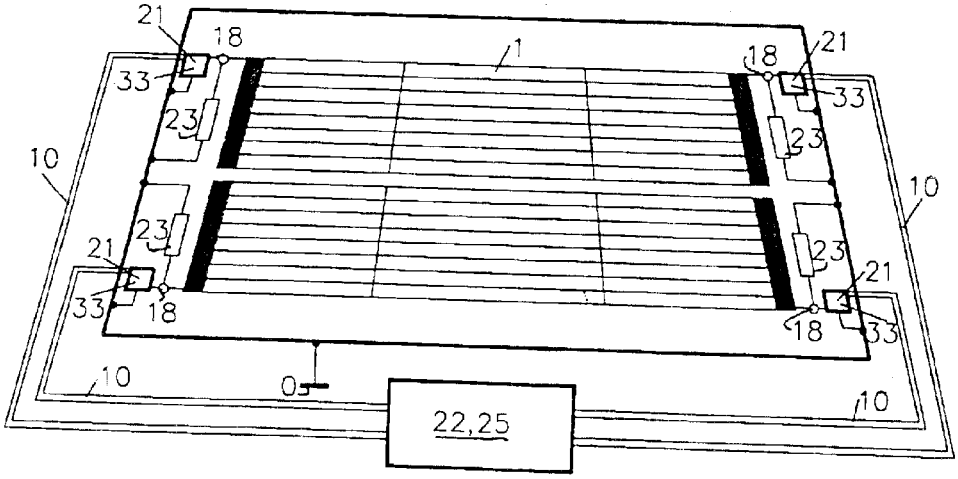
FIG. 16 shows an alternative embodiment of the antenna system as shown in FIG. 15.

FIG. 16 shows a scanning diversity antenna system as in FIG. 15, but with separately determined susceptances 23 to improve the independence of reception signals of passive antenna part 1, in terms of diversity. Each active antenna has a separate control amplifier 33 assigned to it. Because of the electromagnetic radiation couplings that are present between the connection points 18, this independence applies only for the connection points 18 that are operated in no-load. By wiring the connection points 18 together with amplifier circuits 21 according to the invention, high-frequency reception signals 8 are captured at the antenna outputs without feedback. The independence of the reception signals at the connection points 18, in terms of diversity, is therefore not influenced by this measure, in advantageous manner, and this independence consequently exists in the same manner for the reception signals 8 at the antenna outputs. Therefore reception signals 8 that are independent of one another are available at the antenna outputs, for selection in a scanning diversity system, i.e. for further processing in one of the known diversity methods.

In contrast to this, if connection point 18 was wired together with a transformation circuit according to the prior art, circuit of FIG. 2*b*, this would cause dependence of the antenna signals at the antenna output, by way of the currents that flow at connection point 18. This relationship will be explained in greater detail below, for a passive antenna part 1 having two connection points 18:

If U01 and U02 are the no-load voltage amplitudes at connection points 18 of a passive antenna arrangement 27 in FIG. 14 in the reception field, and Z11, Z22 are the antenna impedances measured there, and if, furthermore, Z12 is the interaction impedance on the basis of the coupling of the connection point 18, and if Y1 and Y2 are the input admittances of the amplifiers, with which the connection point is stressed, then the following equation results for the voltage amplitudes at connection points 18 that occur at this point:

$$\begin{pmatrix} U1 \\ U2 \end{pmatrix} = \frac{1}{N} \cdot \begin{pmatrix} 1 - Z22 \cdot Y2 & Z12 \cdot Y2 \\ Z12 \cdot Y1 & 1 - Z11 \cdot Y1 \end{pmatrix} \cdot \begin{pmatrix} U10 \\ U20 \end{pmatrix} \tag{11}$$

with $$N = 1 - Z11 \cdot Y1 - Z22 \cdot Y2 + Z11 \cdot Z22 \cdot Y1 \cdot Y2 - Z12^2 \cdot Y1 \cdot Y2$$

The correlation factor between voltage amplitudes U1 and U2 and therefore also between the antenna output voltages, using the time averages of voltages U1 and U2, comes to:

$$\rho = \frac{\overline{U1 \cdot U2}}{\sqrt{\overline{U1^2} \cdot \overline{U2^2}}} \tag{12}$$

For the case assumed here, for travel in the Rayleigh reception field, no-load reception voltage amplitudes U10 and U20 occur, that are independent of one another. This is expressed by means of a disappearing correlation factor, i.e.:

$$\rho = \frac{\overline{U10 \cdot U20}}{\sqrt{\overline{U10^2} \cdot \overline{U20^2}}} = 0 \tag{13}$$

If the input admittances of the amplifiers with which connection points 18 are loaded, are small enough to be ignored, according to the invention, i.e. Y1=0 and Y2=0, then the voltages U1 and U2 are obtained from Equation (11) as follows:

$$\begin{pmatrix} U1 \\ U2 \end{pmatrix} = \frac{1}{N} \cdot \begin{pmatrix} 1 & 0 \\ 0 & 1 \end{pmatrix} \cdot \begin{pmatrix} U10 \\ U20 \end{pmatrix} \tag{14}$$

The interactions in the unit matrix in Equation 13, which are occupied with the number 0, show that the disappearing decorrelation in voltages U1 and U2, which is described in Equation (13), is maintained with an amplifier circuit 21 according to the invention. An evaluation of Equation (11) on the other hand, results in linking of the two no-load voltages by way of the interaction parameters Z12*Y2 and Z12*Y1, respectively, with the voltages under stress, in each instance, and then the following applies:

$$U1=(1-Z22\cdot Y2)\cdot U10+Z12\cdot Y2\cdot U20 \tag{15}$$

i.e.

$$U2=(1-Z11\cdot Y1)\cdot U20+Z12\cdot Y1\cdot U20$$

It is obvious that if the coupling of the connection points 18 does not disappear, i.e. Z12 does not disappear, the correlation factor will only disappear if Y1=Y2=0.

On the other hand, the above calculations show that if reciprocal dependence of no-load voltages U10 and U20 exists, special values can be found for Y1 and Y2, which will reduce the reciprocal dependence in amplifier input voltages U1 and U2, or make them disappear, by way of the transformation described in Equation 15.

In an advantageous further development of the invention, as indicated in FIG. 16, passive antenna arrangement 27 in wired at its connection points 18, using suitable admittances, and preferably reactive admittances 23, for reasons of noise sensitivity, so that the correlation between the voltages at connection points 18 become smaller, in the interests of greater diversity efficiency. Here, active antennas according to the invention possess the decisive advantage that the determination of such suitable reactive elements can be established independent of sensitivity considerations, to a great extent. This is because, for the radiation resistances $R_A(f)$ that result at the various connection points 18, no precise balancing is necessary. All that is necessary is to require that they belong to the permissible value range described in FIG. 18. To reduce very large reception levels, the level of the selected signal can be passed to a common control amplifier 33 in electronic change-over switch 25, wherein a control signal 42 is formed and passed to transformation networks 31 in amplifier circuits 21 of the active reception antennas, to lower the selected high-frequency reception signal 8, as shown in FIG. 15. In another embodiment, a separate control amplifier 33 can be assigned to amplifier circuits 21 of the active antennas, to monitor the high-frequency reception signal 8 at the antenna output in question, as shown in FIG. 16.

Accordingly, while several embodiments of the present invention have been shown and described, it is obvious that many changes and modifications may be made thereunto without departing from the spirit and scope of the invention.

What is claimed is:

1. An active broad-band reception antenna having a passive antenna part (1), with first and second output connectors (18, 1') with a frequency dependent effective length le for use on a vehicle wherein the internal amplification of its active antenna is reduced when a predetermined reception signal level is exceeded, comprising;

a high-impedance, high frequency control connector (15) connected to the first connector (18) of the passive antenna part (1);

at least one amplifier circuit (21) having at least one three-pole amplification element (2), with its input coupled to said control connector (15);

at least one transformation network (31) disposed within said amplification circuit (21) and comprising an adjustable transformation member (34) having at least one adjustable electronic element (32) coupled to the output (24) of said at least one three pole amplification element (2) for adjustable lowering of the reception signal level; and at least one low loss filter (3) having its input (6) coupled to said adjustable transformation member (34), and an output connected to said network (31), said transformation network (31), having an input admittance (7, 7') at its input (24) designed for receiving low intensity, high-frequency reception signals (8), and loaded with a continuing circuit at its output (4);

a control circuit (33) coupled to the output (4) of said amplification circuit (21) and producing a control signal (42) that is fed back to said adjustable transformation member (34) in said transformation network (31) for producing a counter-coupling and linearizing effect in the high-frequency connection between said amplification element output (24) and the second connector (1') of the passive antenna part (1), so that said input admittance (7') of said transformation network (31) is reduced when there is a reduction of the level of the high-frequency reception signal (8).

2. The active broad-band reception antenna according to claim 1, wherein said transformation member (34) comprises at least one reactive element (32) of said low-loss transformation network (31), and selected so that the frequency dependence of the active admittance G(f) of said input admittance (7) in effect at the input of said transformation network (31) is set so that at a given internal amplification of said amplifier circuit (21), the frequency response signal (8) that results from the frequency-dependent effective length $l_e$ of the passive antenna part (1) is designed within a broad frequency band.

3. The active broad-band reception antenna according to claim 1, wherein said transformation network (31), comprises a series circuit of an adjustable transformation member (34), said low-loss filter circuit (3) having fixed reactive elements with an impedance (5) of the continuing circuit coupled to its output (4), said adjustable transformation element (34) being designed for frequency-independent and low-loss signal transmission if the received signal decreases below a predetermined reception level, and the reactive elements of said low-loss filter circuit (3) are structured so that the frequency dependence of the active admittance G(f) of the input admittance (7) in effect at its input (24) is set so that at a given internal amplification of the active antenna, the frequency response in the high-frequency reception signal (8) that results from the frequency-dependent effective length le of the passive antenna part (1) is structured within a broad frequency band.

4. The active broad-band reception antenna according to claim 1 wherein said transmission network (31) comprises a low-loss filter circuit having fixed reactive elements (20) wherein at least one reactive element (20*a*) can be switched on and off using at least one adjustable electronic element (32) so that if the received signal goes below a predetermined reception level the desired frequency dependence of the active admittance G(f) of the input admittance (7) that is in effect at its input (24) increases internal amplification of the active antenna, and if the received signal goes above a predetermined reception level, the desired frequency dependence of the active admittance G'(f) of the input admittance (7') at its input (24) decreases the internal amplification of the active antenna.

5. The active broad-band reception antenna according to claim 1, wherein said transformation network (31), designed as a filter has a sufficiently small reactive component B(f) in its input admittance (7) if the reception signal goes below a predetermined reception level, and in the case of a predetermined transformation behavior, in order to avoid non-linear effects.

6. The active broad-band reception antenna according to claim 4, wherein for all settings of said at least one adjustable electronic element (32), the amount of the effective counter-coupling input admittance (7,7') outside of the useful frequency band in the stop frequency range of said transformation network (31) designed as a filter and connected to the input connector (24), is sufficiently small to avoid non-linear effects at all settings of said adjustable electric element (32) or elements (32).

7. The active broad-bank reception antenna according to claim 1, wherein said transformation network (31) is formed from the series circuit of said adjustable transformation member (34) designed as a transformation circuit, having an adjustable longitudinal element (30) contained therein, and a low-loss filter circuit (3), and the ratio (t:1) of the input voltage ($U_E$) to the output voltage ($U_A$) of said adjustable transformation member (34) is set to be sufficiently great if a predetermined reception level is exceeded.

8. The active broad-band reception antenna according to claim 7, wherein said adjustable longitudinal element (30) is designed as an electronic resistor (37) having an adjustable PIN diode.

9. The active broad-band reception antenna according to claim 7, wherein said adjustable longitudinal element (30) is formed by one or several resistors (35) switched in series, each having an adjustable electronic element (32) that can be set and switched in parallel with said resistor (35) said electronic element (32) being designed as a switching diode (36) and wherein said related resistor is fully active when said element (32) is set in the cut-off state, and said resistor (35) is shunted when said switching diode (36) is set in the pass-through state, so that said switching diode (36) or diodes are switched on/off appropriately so as to stepwise lower the level of the reception signal.

10. The active broad-band reception antenna according to claim 7, wherein in order to lower the high-frequency reception signals (8) independent of frequency, said adjustable longitudinal element (30) comprises a frequency-dependent dipole (47) having a dipole admittance (46) that is similar, but essentially smaller than the input admittance of said low-loss filter circuit (3), by a frequency-independent factor (t-1) and further comprising a switching diode (36) switched in parallel with said frequency-dependent dipole (47) when the latter is set in the cut-off state and said dipole admittance (46) is active, and when set in the pass-through state, said dipole admittance (46) is shunted so that when said switching diode (36) is cut off, the high-frequency reception signals (8) are reduced by a factor (t), essentially independent of the reception frequency.

11. The active broad-band reception antenna according to claim 10, wherein said frequency-dependent dipole (47) is formed by the input admittance of a dipole filter circuit (48), which is designed as a low-loss filter circuit (3), at least in the essential reactive elements, wherein the reactive elements are selected to be higher in ohms by the frequency-independent factor (t-1) than the corresponding reactive elements of said low-loss filter circuit (3), and wherein in said dipole filter circuit (48) is terminated by an impedance that is selected to be higher in ohms by the same factor than the active impedance (5) of the continuing circuit (4).

12. The active broad-band reception antenna according to claim 1, wherein said transformation network (31) comprises an adjustable transformation member (34) having a transformer (38) with a translation ratio (t) available in steps, and wherein said at least one adjustable element (32) comprises switching diodes (36), which are switched on and off so that at high reception levels, the translation ratio (t), and therefore the ratio of the input voltage UE to the output voltage UA of said adjustable transformation member (34) is set to be correspondingly high.

13. The active broad-band reception antenna according to claim 1, wherein said transformation network (31) has several low-loss filter circuits (3, 3*a*) with reactive elements (20) having a fixed setting, and the input and output of said filter circuits (3, 3*a*) are coupled to switching diodes (36), wherein said filter circuits are alternatively switched between the input and output of said transformation network (31), and the input admittance (7, 7') is formed with said reactive elements (20) so that by using said switching diodes (36), if the value of the reception signal decreased below a predetermined reception level, the desired frequency dependence of the active admittance G(f) of the input admittance (7) in effect at the source connector (24) provides a greater internal amplification of the active antenna, and if the value goes above a predetermined reception level, the desired frequency dependence of the active admittance G' (f) of the input admittance (7') that is in effect at the source connector (24) reduces the internal amplification of the active antenna.

14. The active broad-band reception antenna according to claim 1, wherein said three-pole amplification element (2) comprises a field effect transistor, the gate terminal being connected to the high impedance control connector (15), the source terminal being connected to the source connector (24) and the drain terminal being connected to the drain connector (53).

15. The active broad-band reception antenna for use above 30 MHz according to claim 14, wherein said field effect transistor (2) has a parallel noise current source ir, a very small gate-drain capacitance C1, and a very small gate-source capacitance C2, and an l/f noise that is sufficiently small to be insignificant, and that its minimal noise temperature TNO is significantly lower than the ambient temperature T0 during noise adaption.

16. The active broad-band reception antenna according to claim 1, wherein said three-pole amplification element (2) comprises an expanded three-pole amplification element, consisting of an input field effect transistor (13), and a bipolar transistor (14) being controlled by the source of the latter in an emitter following circuit, and the output of said expanded field effect transistor (2) is formed by its emitter connector (12).

17. The active broad-band reception antenna according to claim 1, wherein said three-pole amplification element (2) comprises an expanded three-pole amplification element, having a first input bipolar transistor (49), a second bipolar transistor (50) being controlled by the emitter of the latter in an emitter follower circuit, and the output connector (24) of the three-pole amplification element (2) being formed by its emitter connector (12), and the closed-circuit current being set to be smaller in said first input bipolar transistor (49) than in said second bipolar transistor (50).

18. The active broad-band reception antenna according to claim 1, wherein said three-pole amplification element (2)

comprises an expanded three-pole amplification element, consisting of an input bipolar transistor (49) or a field effect transistor (13) respectively, the collector, or drain connector of which is connected with the emitter connector of a second transistor (51),and the base or gate connector of which is connected with the emitter, or source connector of said input bipolar transistor (49) or said input field effect transistor (13) respectively, forming the source connector (24) of said three-pole amplification element (2).

19. The active broad-band reception antenna according to claim 1, wherein said three-pole amplification element (2) comprises;

an expanded three-pole amplification element, consisting of an input bipolar transistor (49) or a field effect transistor (13) respectively, the collector connector, or drain connector of which is connected with the emitter connector of a second transistor (51);

an electronically controllable closed-circuit voltage source ($U_{DO}$) coupled to the base or gate connector of said second transistor (51); and an electronically controllable closed circuit current source ($I_{SO}$) coupled to the emitter of said input bipolar transistor (49) so that if overly high reception levels occur, said current ($I_{SO}$) or/and said closed circuit voltage ($U_{DO}$) coupled to said input bipolar transistor (49) or said input field effect transistor (13), respectively, is set higher when there is a reduction of the internal amplification of the reception antenna.

20. The active broad-band reception antenna according to claim 1 wherein the passive antenna part (1) has two signal output connectors (18) with respect to ground (0) and said three pole amplification element (2) has two inputs (15*a*, 15*b*) each connected with one of said antenna part connector (18) and having two output source connectors (24*a, b*); and wherein the drain connectors (53) are connected with the ground (0)

a transformer (38) structured as an isolating transformer having its primary side connected to said two output source connectors (24*a, b*), the secondary side of which has different outputs for structuring different transformer ratios (t), and switching diodes (36) coupled to the outputs of said adjustable member (34).

21. The active broad-band reception antenna according to claim 1, wherein said three pole amplification element comprises a plurality of three pole amplification elements (2,2) and a plurality of bipolar transistors (14, 14') combined with said plurality of three pole amplification elements (2, 2'), the base electrodes of said bipolar transistors (14, 14), being connected with the source electrode of a common input transistor (13, 49) and with the source connector of said expanded three-pole amplification element, and wherein said bipolar transistors (14, 14') are each connected with the input of a low-loss filter circuit (3, 3'), in an emitter follower circuit, to form separate transmission paths for the frequency bands in question, and wherein, there is an adjustable transformation member (34, 34') and a control circuit (33, 33') for each of the transmission paths and only the frequency band assigned to the transmission path in question is passed to the latter from the high-frequency reception signal (8), by way of filter measures, and that said control signal (42, 42') is passed to the assigned adjustable transformation member (34, 34'), in each instance, in order to provide several transmission frequency bands for said reception antenna.

22. The active broad-band reception antenna according to claim 21, wherein said control circuit (33) comprises a receiver (44) having control amplifiers (33, 33') for producing control signals (42, 42') derived from the output signal of said active antenna by means of selection means, and passed to the active antenna by way of control lines (41) connected to said adjustable transformation member (34).

23. The active broad-band reception antenna according to claim 1, wherein a plurality of passive antenna parts (1) are present, which have directional diagrams with effective lengths $l_e$ that are frequency-dependent and differ with respect to incident waves, by amount and phase, but are in electromagnetic radiation coupling with one another and together form a passive antenna arrangement (27) having several output connection points (18*a, b, c*), and wherein said amplification circuit has a plurality of amplifier circuits (21*a, b, c*) connected with it, in each instance, and is supplemented to form an active antenna, so that by switching on said amplifier circuits (21*a, b, c*) at the passive antenna parts (1), no noticeable reciprocal influence of the reception voltages exists;

an antenna combiner (22) for bringing together the high-frequency signals (8*a, b, c*) in weighted manner and said control circuit (33) comprises at least one control amplifier (33) for monitoring the high-frequency reception signals (8) in the active reception antennas, at the antenna output, in each instance.

24. Active broad band reception antenna according to claim 23, wherein said control amplifier (33) is a common control amplifier (33), the control signal (42*a, b, c*) of which is passed to said transformation networks (31*a, b, c*) in the active antennas, to lower the level of the totaled high-frequency reception signal (8).

25. The active broad-band reception antenna according to claim 24, wherein the active reception antennas are used in an antenna diversity system of vehicles, and that the passive antenna parts (1) are selected so that their reception signal, that are present in a Rayleigh reception field, are as independent of one another as possible in terms of diversity, and that the high frequency reception signals (8) are made available without feedback, and without influencing the independence of the reception signals in terms of diversity, for selection in a scanning diversity system, and for further processing in one of the known diversity methods.

26. The active broad-band reception antenna according to claim 25, wherein the active reception antennas are used in an antenna diversity system for vehicles, and the passive antenna parts (1) are selected so that their reception signals that are present in a Rayleigh reception field, are as independent of one another as possible, in terms of diversity, and that the high-frequency reception signals (8) are made available without feedback, so as not to influence the independence of the reception signals in terms of diversity, for selection in a scanning diversity system, and for further processing in one of the known diversity methods, and that the level of the selected signal is passed to said common control amplifier (33), in which a control signal (42) is formed and passed to said transformation networks (31) in the active reception antennas, to reduce the selected high frequency reception signal (8).

27. The active broad-band antenna according to claim 25, wherein said control amplifier (33) is present in each of said active reception antennas (21), to monitor the high-frequency reception signals (8) at the antenna output.

28. The active broad-band antenna according to claim 25, comprising a plurality of susceptances, each coupled parallel to the input of each amplifier circuit (12) to improve the independence, in terms of diversity, of the reception signals of the passive antenna parts (1) at their connection points (18) particularly determined for this purpose.

29. The active broad-band antenna according to claim 1, wherein said transmission network (31) is set for small high-frequency reception signals (8), the active admittance (5) in effect at the output (4) of said low-loss filter circuit (3) is structured by the input resistance of a high-frequency line (10) loaded with the load resistance (9) at its end, and that the load resistance (9) is formed by the input impedance of a continuing amplifier unit (11) having the noise number $F_v$, and that the real part G of the active admittance (7) is selected to be sufficiently large so that the noise contribution of said amplifier unit (11) is smaller than the noise contribution of said field effect transistor (2).

30. The active broad-band antenna according to claim 1, comprising a transformer (24') having a suitable transformer ratio ü, coupled between the passive antenna part (1) and the input of said amplifier circuit (21) in order to create advantageous transformation conditions over a broad band.

31. The active broad-band reception antenna according to claim 1 wherein, frequency-selective transmission paths for a frequency-selective uncoupling of high-frequency reception signals (8) for different transmission frequency bands are structured in the loss filter circuit (3), several outputs, using signal branchings.

32. The active broad-band reception antenna according to claim 1 wherein the passive antenna part (1) comprises a passive antenna arrangement (27) having conductor structures disposed on plastic carrier introduced into the recess of a conductive vehicle body, or onto the window of a vehicle, in the form of one or more heating fields and conductor structures separate from the heating system, and wherein several connection points (18) are provided on these conductor structures to form passive antenna parts (1), to connect said amplifier circuits (21).

33. The active broad-band reception antenna according to claim 1, wherein the passive antenna arrangement (27) is structured as an essentially integral conductive surface, having sufficiently low surface resistance and applied to the window of a car, in order to suppress radiation transmission in the infrared range, and that suitably positioned connection points (18) having corresponding amplifier circuits (21) are formed on the edge of the conductive surface, not connected with the conductive car body, in order to uncouple reception signals, the high-frequency reception signals (8) of which circuits are passed to an antenna combiner (22), in order to form a directional antenna, or to an electronic transformer (25), in order to provide a scanning diversity system, or to provide a working diversity arrangement.

34. The active broad-band reception antenna according to claim 1, wherein the passive antenna part is derived from a vehicle part that was not originally intended for use as an antenna, and can be changed only very little in its structure, and that a connection point (18) for the formation of a passive antenna part (1) is formed on this element, and that a specific azimuthal average Dm of the coefficient of directively is determined for the polarization and elevation of an incident wave that applies in the useful frequency range, and that the real part $R_A$ of the impedance $\underline{Z}_A$ of the passive antenna part (1) exists in the transmission frequency range, in the range between $R_{Amin}$ and a maximum value $R_{Amax}$.

35. The active broad-band reception antenna according to claim 1, wherein a modern digital computer is provided to determine both the impedance $\underline{Z}$A of the passive antenna part (1), by means of measurement technology or by calculations, and the azimuthal average Dm of the coefficient of directivity, determined by means of measurement technology, or by calculations, and stored in the digital computer, and in which suitable basic structures for low-lee filer circuits (3) are stored in the computer for various characteristic possible progressions of antenna impedances, and that the reactive element of said low-loss filter circuit (3) for a given average gain of the active antenna are determined using known strategies of variation calculations.

36. The active broad-band reception antenna according to claim 1, wherein said low-loss filter circuit (3) comprises a T half-filter or T-filter or a chain circuit of such filters, the serial and the parallel branch, respectively of said filters being formed of a combination of reactive resistors, so that both the absolute value of a reactive resistor in the serial branch (28), and the absolute value of a reactive resistor in the parallel branch (29) are sufficiently small, each case within a transmission frequency range, and sufficiently large outside such a range, and that said high-frequency reception signal (8) is passed to said control amplifier (33) at is output so that said adjustable transformation member (34) is controlled by the control signal (42) of said control amplifier.

37. The active broad-band reception antenna according to claim 1, further comprising a high frequency line (10) contained in said low-loss filter circuit (3) as an element that transforms the active admittance (7) in frequency-dependent manner, in order to spatially separate the front end of the active antenna that is structured in miniaturized form.

38. The active broad-band reception antenna according to claim 1, wherein the passive antenna part (1), designed as a printed conductor structure on a dielectric carrier, such as, the window or a plastic carrier, and said low-loss filter circuit (3) is designed as a band-pass filter in the VHF frequency range, and a high-ohm input impedance outside of the VHF frequency range.

39. The active broad-band reception antenna according to claim 1 comprising a transformer (24) having a sufficiently high-ohm primary inductance, and a suitably selected transformer ratio, coupled between said first connector (18) and the input of said amplifier circuit (21) in order to increase the effect length le of the passive antenna part (1), over a broad band.

40. An active broad-band reception antenna having a passive antenna part (1), with at least one output connector (18,) with a frequency dependent effective length le for use on a vehicle, wherein the internal amplification of its active antenna is reduced when a predetermined reception signal level is exceeded, comprising;

an least one amplifier circuit (21) having at least one three-pole amplification element (2, 13, 14)), with its input coupled to at least one output connector (18) of the antenna part (1);

at least one transformation network (31) disposed within said amplification circuit (21) and having at least one adjustable electronic element (32), and coupled to the output (24) of said at least one three pole amplification element (2) for adjustable lowering of the reception signal level;

a low loss filter (3) having its input (6) coupled to said adjustable transformation network (31), and having an input admittance (7, 7') designed for receiving low intensity, high-frequency reception signals (8), and loaded with a continuing circuit at its output (4) for producing the high frequency reception signal (8); and a control circuit (33) coupled to the output (4) of said amplification circuit (21) and producing a control signal (42) that is fed back to said transformation network (31) for producing a counter-coupling and linearizing effect in the high-frequency output of said amplification element output (24) and said at least one output of the passive antenna part (1), so that said input admittance (7') of said transformation network (31) is reduced when there is a reduction of the level of the high-frequency reception signal (8).

41. The active broad-band reception antenna according to claim 40, wherein the active reception antennas are used in an antenna diversity system of vehicles, and that the passive antenna parts (1) are selected so that their reception signal, that are present in a Rayleigh reception field, are as independent of one another as possible in terms of diversity, and that the high frequency reception signals (8) are made available without feedback, and without influencing the independence of the reception signals in terms of diversity, for selection in a scanning diversity system, and for further processing in one of the known diversity methods.

42. The active broad-band reception antenna according to claim 40, wherein the active reception antennas are used in an antenna diversity system for vehicles, and the passive antenna parts (1) are selected so that their reception signals that are present in a Rayleigh reception field, are as independent of one another as possible, in terms of diversity, and that the high-frequency reception signals (8) are made available without feedback, so as not to influence the independence of the reception signals in terms of diversity, for selection in a scanning diversity system, and for further processing in one of the known diversity methods, and that the level of the selected signal is passed to said common control amplifier (33), in which a control signal (42) is formed and passed to said transformation networks (31) in the active reception antennas, to reduce the selected high frequency reception signal (8).

43. The active broad-band antenna according to claim 40, wherein said control amplifier (33) is present in each of said active reception antennas (21), to monitor the high-frequency reception signals (8) at the antenna output.

44. The active broad-band antenna according to claim 40, comprising a plurality of susceptances, each coupled parallel to the input of each amplifier circuit (12) to improve the independence, in terms of diversity, of the reception signals of the passive antenna parts (1) at their connection points (18) particularly determined for this purpose.

45. The active broad-band antenna according to claim 40, wherein said transmission network (31) is set for small high-frequency reception signals (8), the active admittance (5) in effect at the output (4) of said low-loss filter circuit (3) is structured by the input resistance of a high-frequency line (10) loaded with a load resistance (9) at its end, and that said load resistance (9) is formed by the input impedance of a continuing amplifier unit (11) having the noise number $F_v$, and that the real part G of the active admittance (7) is selected to be sufficiently large so that the noise contribution of said amplifier unit (11) is smaller than the noise contribution of said field effect transistor (2).

46. The active broad-band reception antenna according to claim 40 wherein the passive antenna part (1) comprises a passive antenna arrangement (27) having conductor structures disposed on plastic carrier introduced into the recess of a conductive vehicle body, or onto the window of a vehicle, in the form of one or more heating fields and conductor structures separate from the heating system, and wherein several connection points (18) are provided on these conductor structures to form passive antenna parts (1), to connect said amplifier circuits (21).

* * * * *